US006937737B2

(12) United States Patent
Polk, Jr.

(10) Patent No.: US 6,937,737 B2
(45) Date of Patent: Aug. 30, 2005

(54) MULTI-CHANNEL AUDIO SURROUND SOUND FROM FRONT LOCATED LOUDSPEAKERS

(75) Inventor: Matthew S. Polk, Jr., Gibson Island, MD (US)

(73) Assignee: Britannia Investment Corporation, San Diego, CA (US)

( * ) Notice: Subject to any disclaimer, the term of this patent is extended or adjusted under 35 U.S.C. 154(b) by 0 days.

(21) Appl. No.: 10/692,692

(22) Filed: Oct. 27, 2003

(65) Prior Publication Data

US 2005/0089181 A1 Apr. 28, 2005

(51) Int. Cl.[7] ..... H04R 5/02
(52) U.S. Cl. ..... 381/300; 381/27
(58) Field of Search ..... 381/300, 307, 381/309, 310, 27, 1, 17–19

(56) References Cited

U.S. PATENT DOCUMENTS 4,199,658 A 4/1980 Iwahara
4,489,432 A 12/1984 Polk
4,497,064 A 1/1985 Polk
4,569,074 A 2/1986 Polk (Continued)

*Primary Examiner*—Xu Mei
*Assistant Examiner*—Con P. Tran
(74) *Attorney, Agent, or Firm*—Sterne, Kessler, Goldstein & Fox P.L.L.C.

(57) ABSTRACT

A surround sound reproduction system uses a series of filters and a system of main and sub-speakers to produce phantom rear surround sound channels or a phantom surround sound effect from a loudspeaker system or pair of loudspeaker systems located in front of the listener. The sound system includes left and right surround input signals, and left and right front input signals. Left and right sub-speakers, and left and right main speakers are located in front of a listening location. Spacing between respective main and sub-speakers is approximately equal to ear spacing for an average person. The input to the left sub-speaker comprises the right surround signal subtracted from the left surround signal each signal having previously passed through a front-to-back filter and a series of high and low pass filters. The input into the left main speaker comprises the left front signal added to the left surround signal after the left surround signal has passed through a front-to-back filter. The input into the right sub-speaker comprises the left surround signal subtracted from the right surround signal each signal having previously passed through a front-to-back filter and a series of high and low pass filters. The input into the right main speaker comprises the right front signal added to the right surround signal after the right surround signal has passed through a front-to-back filter.

59 Claims, 24 Drawing Sheets

U.S. PATENT DOCUMENTS 4,630,298 A 12/1986 Polk et al.
4,748,669 A 5/1988 Klayman
4,847,904 A 7/1989 McShane
4,893,342 A 1/1990 Cooper et al.
4,910,779 A 3/1990 Cooper et al.
4,975,954 A 12/1990 Cooper et al.
5,034,983 A 7/1991 Cooper et al.
5,117,459 A 5/1992 McShane
5,136,651 A 8/1992 Cooper et al.
5,263,086 A 11/1993 Yamazaki
5,265,166 A 11/1993 Madnick et al.
5,333,200 A 7/1994 Cooper et al.
5,438,623 A 8/1995 Begault
5,459,790 A 10/1995 Scofield et al.
5,533,129 A 7/1996 Gefvert
5,579,396 A 11/1996 Iida et al.
5,581,618 A 12/1996 Satoshi et al.
5,590,204 A 12/1996 Lee
5,594,801 A 1/1997 McShane
5,598,478 A 1/1997 Tanaka et al.
5,684,881 A 11/1997 Serikawa et al.
5,703,955 A 12/1997 Fels et al.
5,740,253 A 4/1998 Takeuchi
5,799,094 A 8/1998 Mouri
5,822,438 A * 10/1998 Sekine et al. ..... 381/17
5,912,976 A 6/1999 Klayman et al.
6,026,169 A 2/2000 Fujimori
6,052,470 A 4/2000 Mouri
6,160,894 A 12/2000 Kishigami et al.
6,173,061 B1 1/2001 Norris et al.
6,243,476 B1 * 6/2001 Gardner ..... 381/303
6,307,941 B1 10/2001 Tanner, Jr. et al.
6,424,719 B1 * 7/2002 Elko et al. ..... 381/1
6,633,648 B1 * 10/2003 Bauck ..... 381/303

* cited by examiner

Fig. 2 Transformation of sound pressure level from the free field to the human eardrum in the horizontal plane as a function of frequency at 15° intervals of azimuth θ. Curves show average values based on data from 12 studies. (After Ref. 6).

Near Ear - Front to Back Frequency Response Differences

Far Ear - Front to Back Frequency Response Differences

Front to Back Frequency Response Differences
Far Ear vs Near Ear

Left to Right Frequency Response Differences

MULTI-CHANNEL AUDIO SURROUND SOUND FROM FRONT LOCATED LOUDSPEAKERS

BACKGROUND OF THE INVENTION

1. Field of the Invention

This invention relates generally to the reproduction of sound in multichannel systems generically known as "surround-sound" systems and more specifically to the application of psychoacoustic principles in the design of a loudspeaker system for reproducing a surround sound experience from loudspeakers located only in front of the listener.

2. Background Art

It has long been recognized that it is possible to use interaural crosstalk cancellation (IACC) and head related transfer functions (HRTF) to expand the perceived soundstage of a two channel audio system or to create the illusion of sounds coming from phantom locations independent of the actual location of the loudspeakers. Through the 1970's and 1980's a number of audio components were available for purchase which used IACC to expand the perceived soundstage. However, until the availability of inexpensive, powerful digital signal processing (DSP) more accurate generation of phantom sound sources at specific locations was very difficult and costly due to the complexity of accurate HRTF synthesis.

More recently the availability of DSP and improved filtering algorithms has made it possible to create a phantom sound source in almost any location using just a single pair of loudspeakers typically located in front of the listener. Using variations of the same techniques it is possible to create several phantom sound sources at the same time from a single pair of loudspeakers typically located in front of the listener. This technique has many practical applications. For example, the experience of having front, rear and center speakers as in a complete 5.1 surround sound audio system can be simulated using a single pair of loudspeakers or headphones.

These techniques are based on the way in which human beings process sounds received by their ears to determine the location of the sources of those sounds. In general, we hear the direction of sounds based on two primary mechanisms, Interaural Time Delays (ITD) and Interaural Level Differences (ILD). ITD refers to the additional time required for a sound located to one side of the listeners head to arrive at the opposite side ear as compared to the time required to reach the near side ear. The ITD of a sound allows the listener to determine the lateral direction of a sound with great precision. ILD refers to the difference in perceived intensity between the listeners two ears for a sound arriving from a particular location. For example, a sound located to the listeners left would appear generally louder in the left ear as compared to the right car due to a reduction in loudness as the sound passes across the listener's head. Overall intensity differences between the ear reinforce lateral localization of sounds through ITD's. In addition, sounds arriving from a particular direction produce a complicated frequency response pattern at each ear which is characteristic of that specific directional location. The combination of these characteristic directional frequency response curves and the ITD's associated with sounds arriving from that direction are referred to as Head Related Transfer Functions (HRTF). The frequency response component of the HRTF's is quite complex and somewhat different for each individual. It is the detailed structure of the HRTF frequency response at each ear that allows the listener to determine the elevation of a sound and whether it is in front or behind. For example, a sound source located 60 degrees to the left and in front of the listener has the same ITD (approx. 300 ms) as a sound source located at 60 degrees left and behind the listener. However, the asymmetry of the outer ear produces very different HRTF's for those two sound source locations thereby allowing the listener to determine both the lateral location and front versus back. A similar mechanism allows the listener to determine the approximate elevation of a sound source. In general the mechanism for determining lateral location of sounds based on ITD's operates in the frequency range of approximately 150 Hz to 1,200 Hz. The mechanisms for localizing sounds based on the frequency response of HRTF's operates from approximately 500 Hz to above 12,000 Hz.

Based on these principles various methods have been devised for canceling interaural crosstalk in loudspeakers, generating phantom sound sources from monaural signals using synthetic or measured HRTF's and for using HRTF's to create phantom rear channels for an audio surround sound system from only a front pair of speakers.

In general, methods using HRTF's to create phantom sound sources, whether for simulation of a surround sound audio system or other application, have a number of practical limitations. Accurate representation of HRTF's is very computation intensive and it is therefore difficult to obtain sufficient accuracy using practical and cost efficient DSP methods. For example, U.S. Pat. No. 6,173,061, which describes a method for phantom sound source generation using HRTF's, acknowledges the need for more efficient sound processing algorithms and seeks to address this problem. Additionally, the specific HRTF's used in prior art methods are selected on the basis of assumptions regarding the characteristics of the loudspeakers employed, the specific positional relationship between the loudspeakers and the listener, and the variation of actual HRTF's from listener to listener. Given the highly specific and detailed nature of HRTF's, those skilled in the art will recognize that changes in the loudspeaker characteristics or locations combined with movement of the listener away from the assumed listening location can easily destroy the phantom sound source illusion. Also, the actual HRTF's of some listeners may be too different from the HRTF's employed in the device for the illusion to work. For example, U.S. Pat. No. 4,893,342 and its related patents describe methods for increasing the positional flexibility of an HRTF based method by limiting the frequency range of the HRTF representations to a range of approximately 600 Hz to 10 kHz and methods for determining listener tolerant HRTF's.

Some known methods for creating phantom sound locations and sources rely on the use of binaurally recorded signals or other specially recorded signals as inputs. These methods may be subject to the above described limitations and will also function properly only when using input signals made with the specified recording scheme. For example, U.S. Pat. No. 4,199,658 describes such a method based on the use of binaurally recorded signals as inputs.

Finally, most known methods for creating phantom rear channel sound sources seek to reproduce the illusion that actual loudspeakers are located at specific locations behind the listener. Such methods are disclosed, for example, in U.S. Pat. No. 6,052,470 and its related patents which describe various methods for using HRTF's to create the illusion of a pair of speakers located behind the listener. However, those skilled in the art generally agree that in rear channel sound reproduction for an audio surround sound system, diffuse localization is preferable to the type of specific localization provided by actual rear located direct radiator loudspeakers. Furthermore, as will be understood by those skilled in the art, audio surround sound systems composed of front and rear pairs of speakers are not effective in localizing sounds in the general areas
directly to the left and right of a listener located centrally between the two pairs of speakers.

Therefore, there exists a need for methods for creating phantom rear surround sound channels which require less complicated signal processing, which are more tolerant of loudspeaker characteristics, loudspeaker placement, listener location and listener to listener HRTF variations, which are effective when using commonly available recordings and which are capable of diffuse localization of rear channel sounds in an audio surround sound system over a range of locations around the listener.

BRIEF SUMMARY OF THE INVENTION

Therefore, it is an object of this invention to provide a device and method for producing phantom rear surround sound channels or a phantom surround sound effect from a loudspeaker system or pair of loudspeaker systems located in front of the listener. An additional object of this invention is to permit implementation using simple analog filters or simple DSP. It is another object of the present invention to be more tolerant of loudspeaker characteristics, loudspeaker placement, listener location and listener to listener variation. Yet another object of this invention is to create effective surround sound reproduction when using commonly available audio surround sound recordings. A further object of this invention is to generate phantom sound sources that are perceived as originating from a range of different locations around or behind the listener including the general areas directly to the left and right of the listener.

U.S. Pat. Nos. 4,489,432; 4,497,064; 4,569,074 and 4,630,298 disclose a method for using an arrangement of main and sub-speakers in a stereo sound reproduction system to cancel IAC and to produce a realistic acoustic field extending beyond the loudspeaker locations using signals from commonly available stereo recordings. The disclosures of these patents are incorporated herein in their entirety by reference. For example, prior art FIG. 1 (FIG. 10 of U.S. Pat. No. 4,489,432) shows specifically how an arrangement of main and sub-speakers can be used to create a phantom sound source outside the boundaries of the loudspeaker locations from two input signals. Based on the disclosures of U.S. Pat. Nos. 4,489,432; 4,497,064; 4,569,074 and 4,630,298 it will be apparent to those skilled in the art that a system constructed in accordance with these disclosures is capable of creating phantom sound sources anywhere in front of the listener more or less independent of the loudspeaker locations according to the localization information contained in the two recorded signals used as inputs. The methods described in these patents are also capable of creating a stable sound image when no localization information exists in the two recorded signals used as inputs.

In accordance with one embodiment of the present invention, in an audio reproduction system having at least four inputs for accepting at least four audio input signals, for example, left front, right front, left surround and right surround channel signals, a right main speaker and a left main speaker are provided respectively at right and left main speaker locations along a speaker axis which are equidistantly spaced from the principle listening location. The principle listening location LL is generally defined as a spatial position for accommodating a listener's head facing the main speakers along a central listening axis and having a right ear location and a left ear location along an ear axis, with the right and left ear locations separated by a maximum interaural sound distance of $\Delta t_{max}$ and the principle listening location is specifically defined as the point on the ear axis equidistant to the right and left ears. The central listening axis CLA is defined as a line passing through the principle listening location and a point on the speaker axis equidistant from the right and left main speakers. A right sub-speaker and a left sub-speaker are provided at right and left sub-speaker locations substantially on the speaker axis of the left and right main speakers and which are equidistantly spaced from the principle listening location LL. By careful location of the sub-speakers relative to the main speakers, use of proper modifications and combinations of the left and right surround signals to create driving signals for the main and sub-speakers, and appropriate filtering of the component parts of said driving signals, a listener located in the principle listening location LL perceives a surround sound experience from speakers located only in front of the listener.

BRIEF DESCRIPTION OF THE DRAWINGS FIGURES

FIG. 1 is a diagram illustrating an apparent source location as produced by the arrangement disclosed in U.S. Pat. No. 4,489,432, FIG. 10.

FIG. 2 is a diagram showing a first embodiment of the present invention.

FIG. 2*a* is a diagram showing the signal combinations of a first embodiment of the present invention.

FIG. 2*b* is a diagram showing the addition of a fifth audio input signal to the first embodiment of the present invention.

Figure 13:
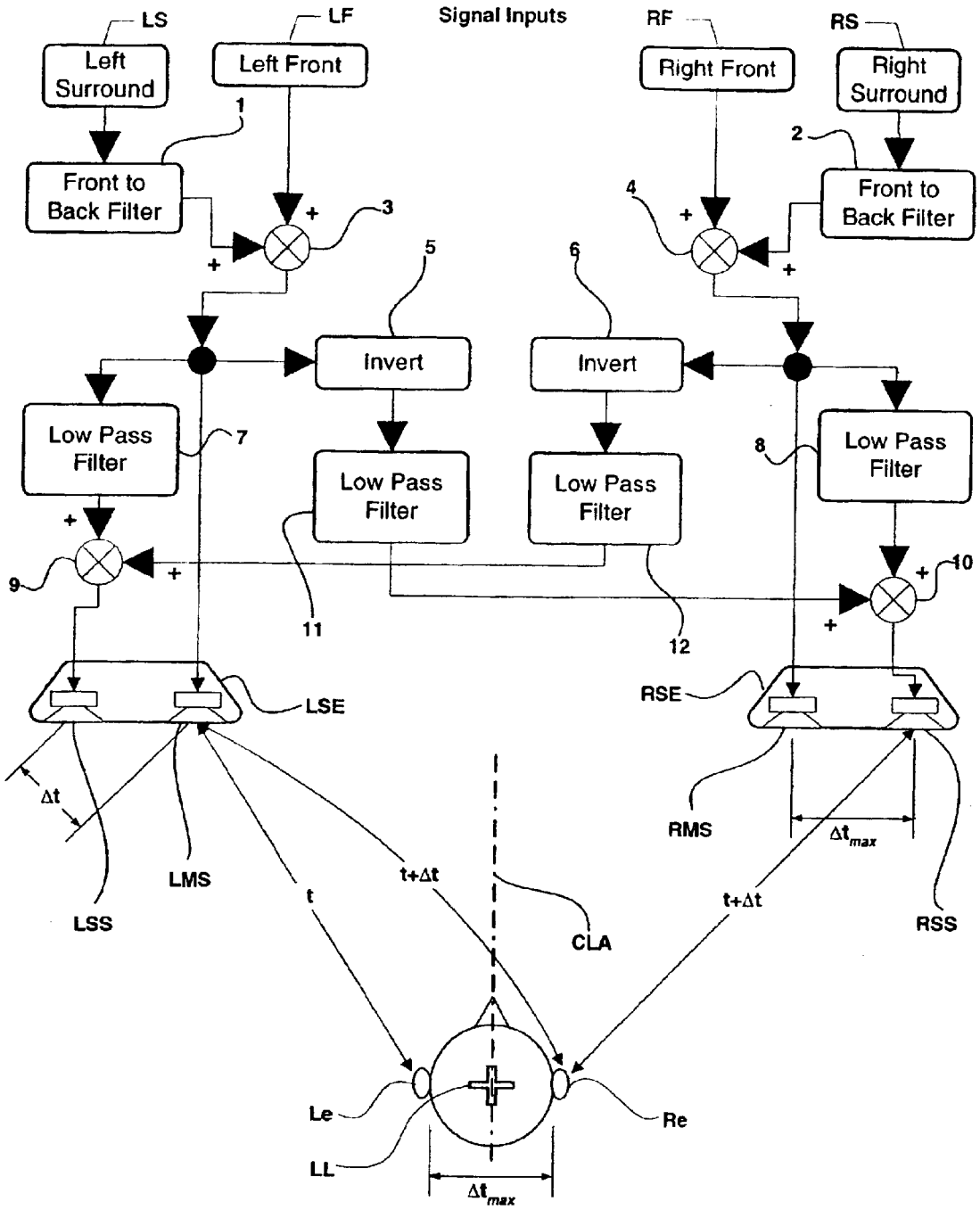
FIG. 13 is a diagram showing a fifth embodiment of the present invention.
Figure 13A:
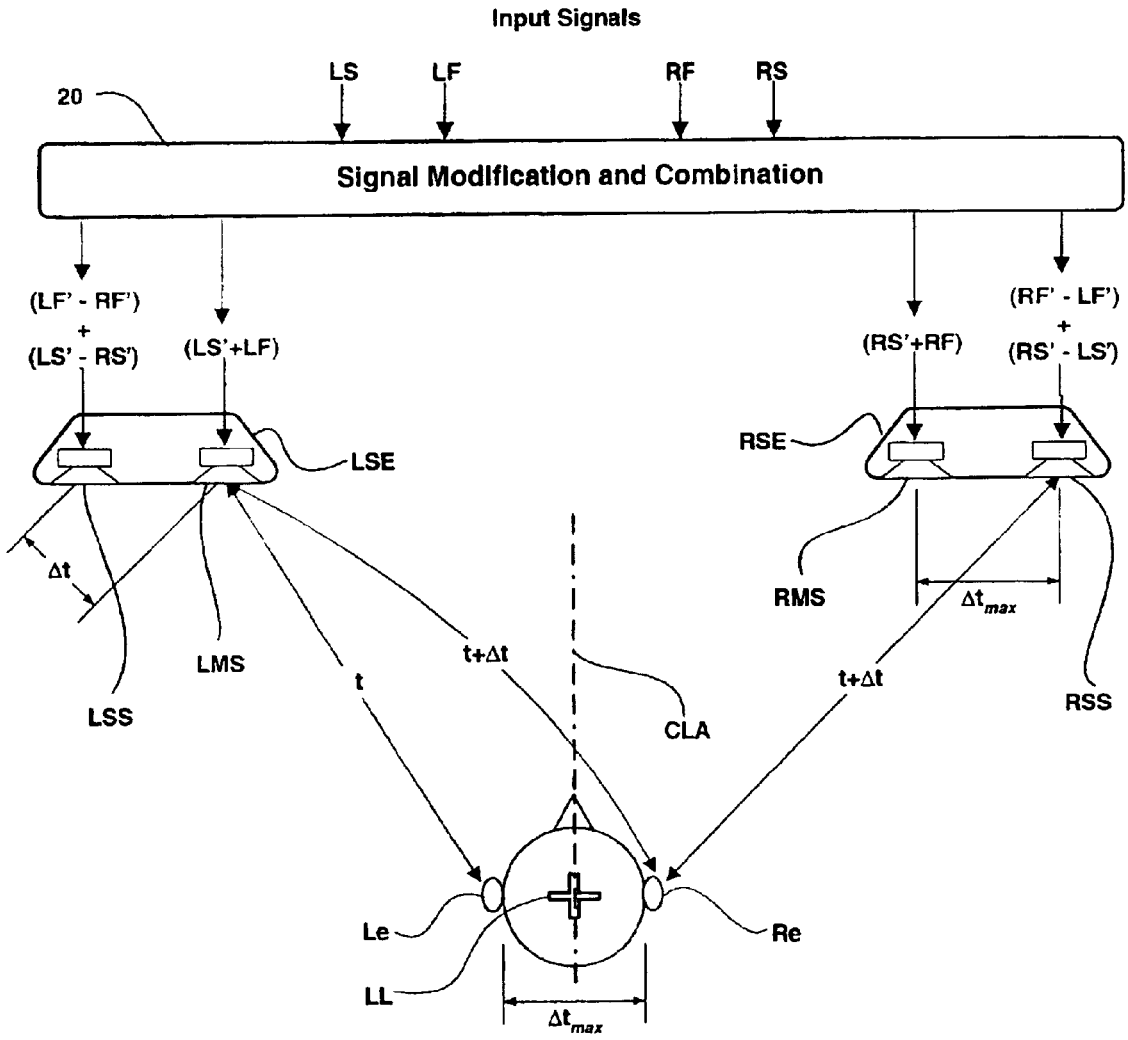

FIG. 13*a* is a diagram showing the signal combinations of a fifth embodiment of the present invention.

Figure 14:
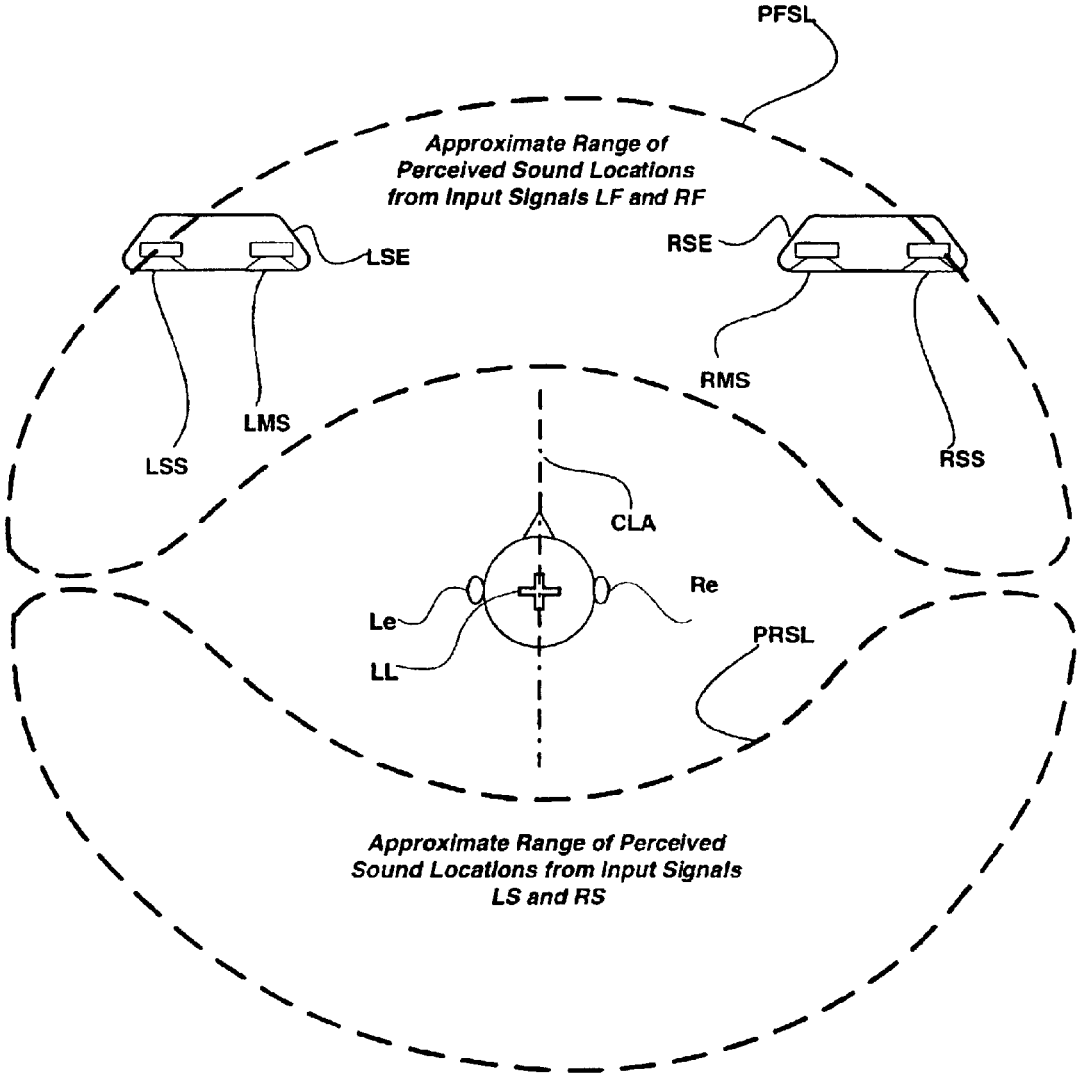

FIG. 14 is a diagram showing approximate perceived sound locations in front of the listener and apparent perceived sound locations to the rear of the listener when using a fifth embodiment of the present invention.

Figure 15:
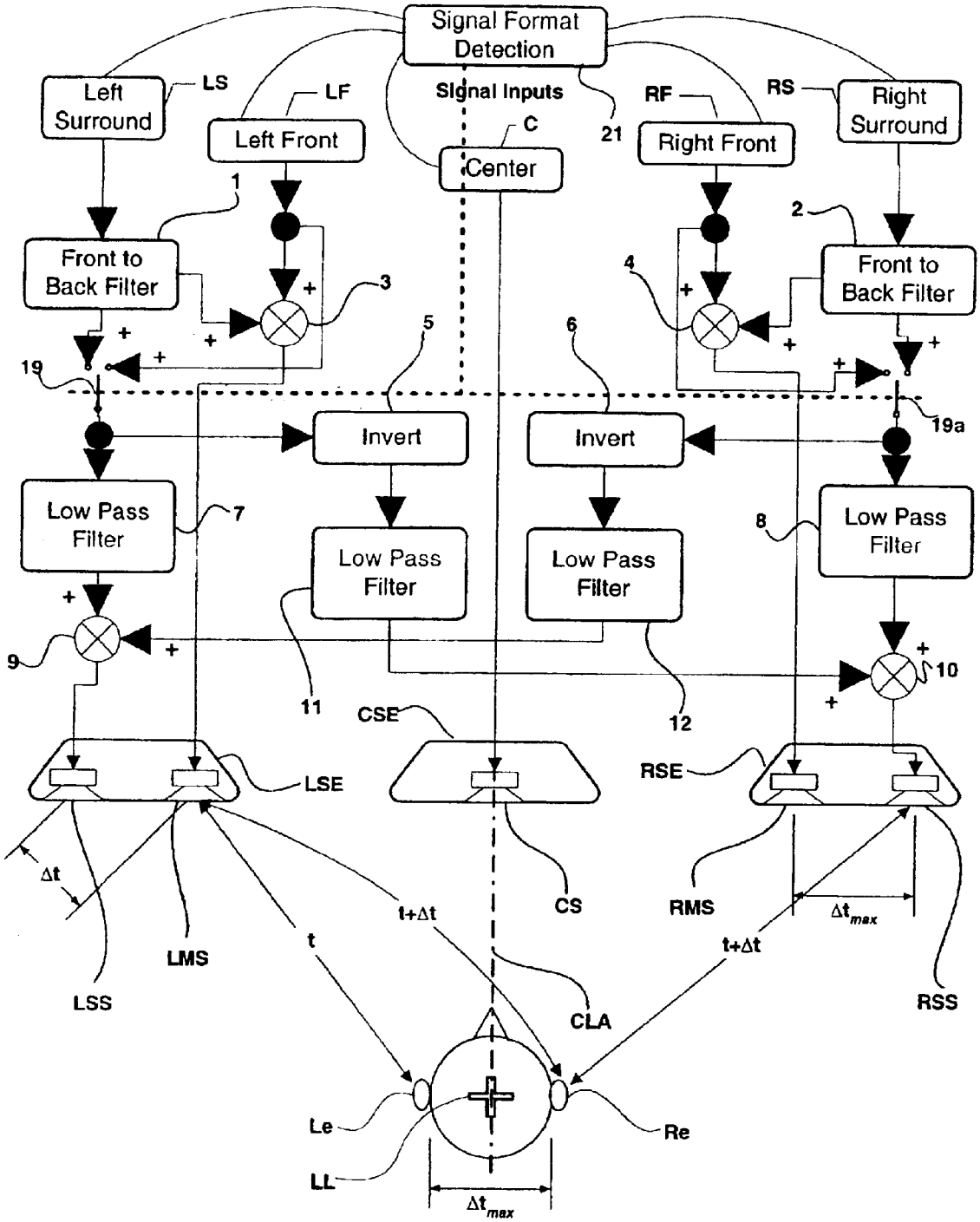

FIG. 15 is a diagram showing a sixth embodiment of the present invention.

Figure 16:
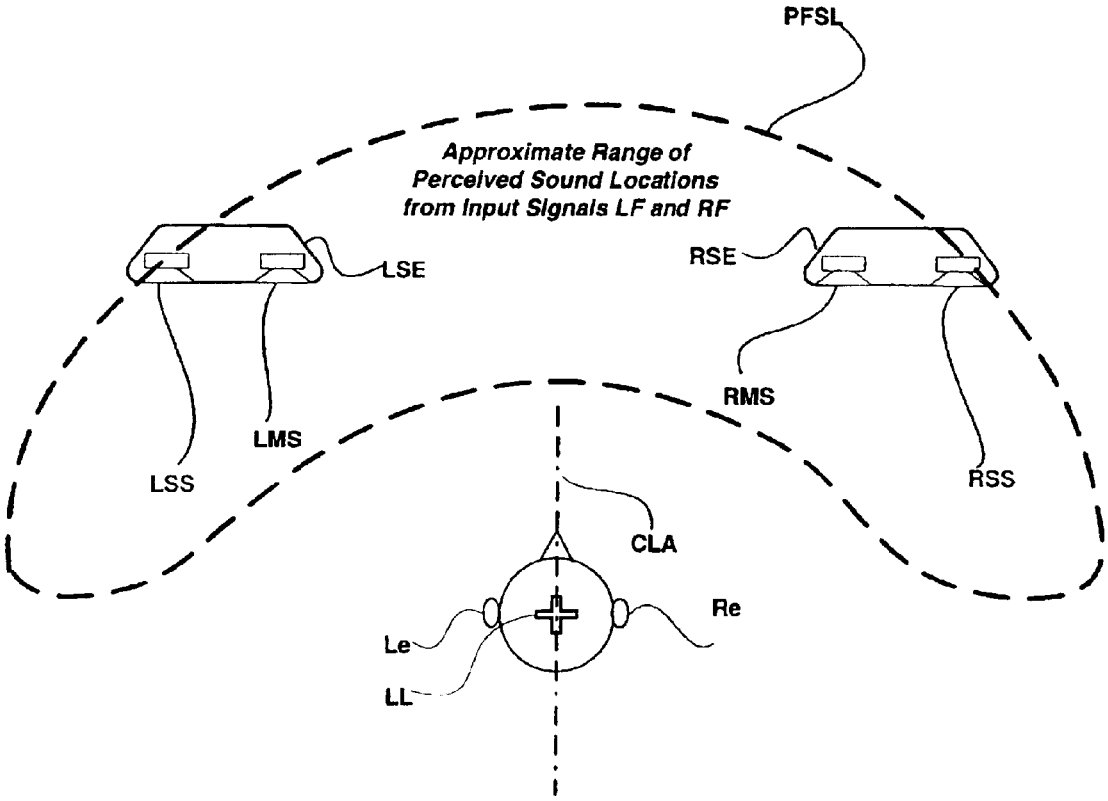

FIG. 16 is a diagram showing approximate perceived sound locations in front of the listener when using a sixth embodiment of the present invention.

Figure 17:
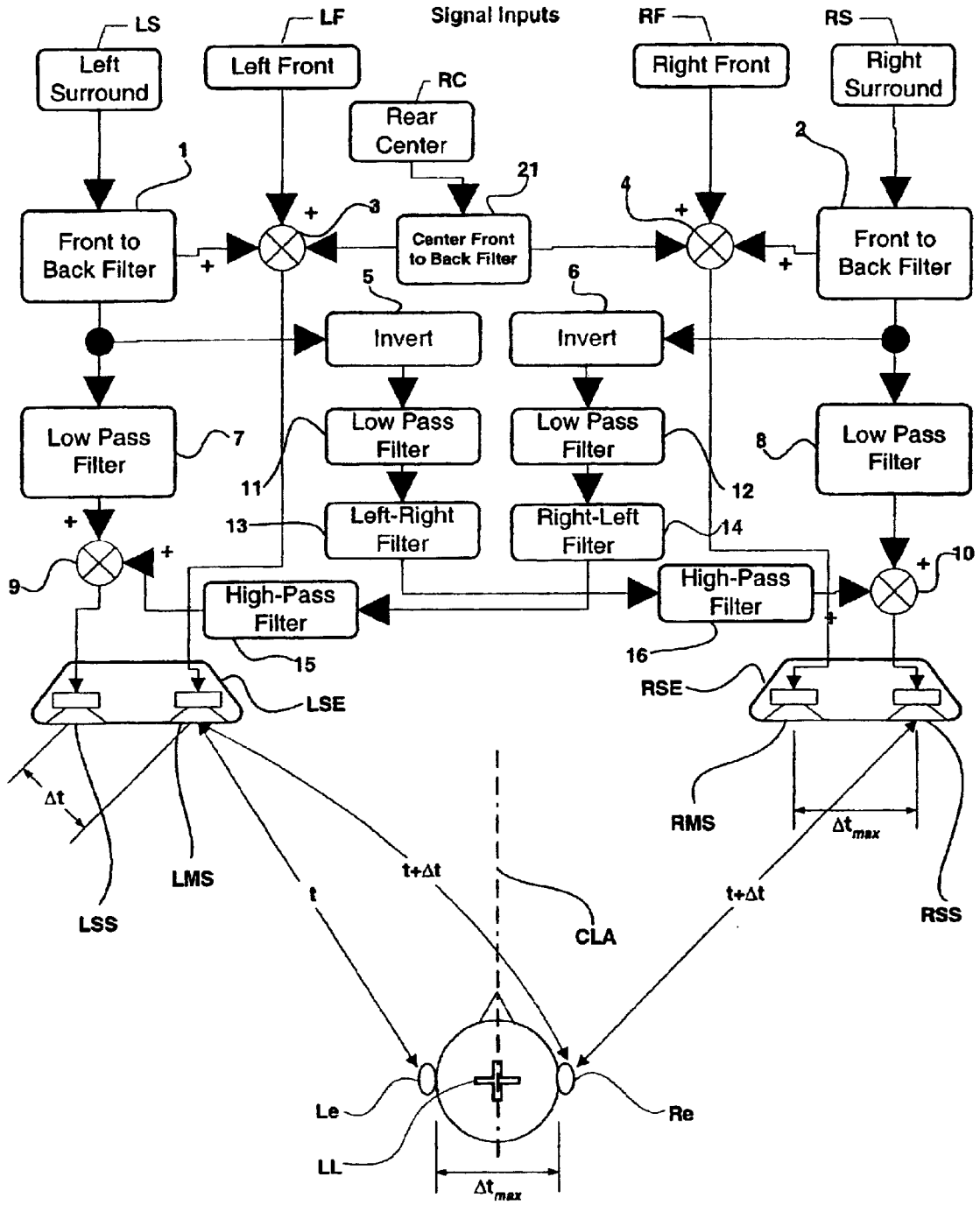

FIG. 17 is a diagram showing an seventh embodiment of the present invention.

Figure 18:
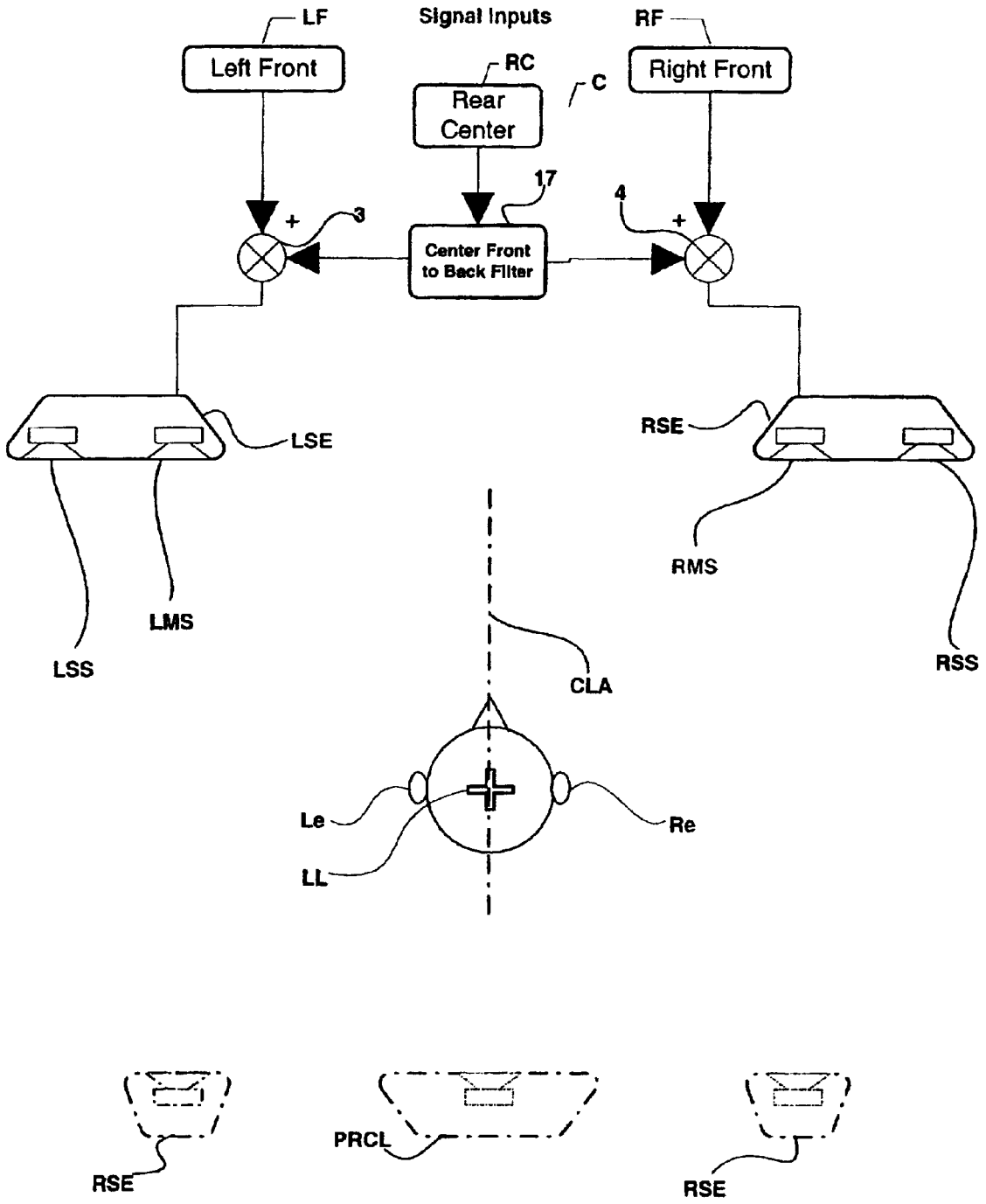

FIG. 18 is a diagram showing approximate apparent perceived sound locations to the rear of the listener when using an seventh embodiment of the present invention.

Figure 19:
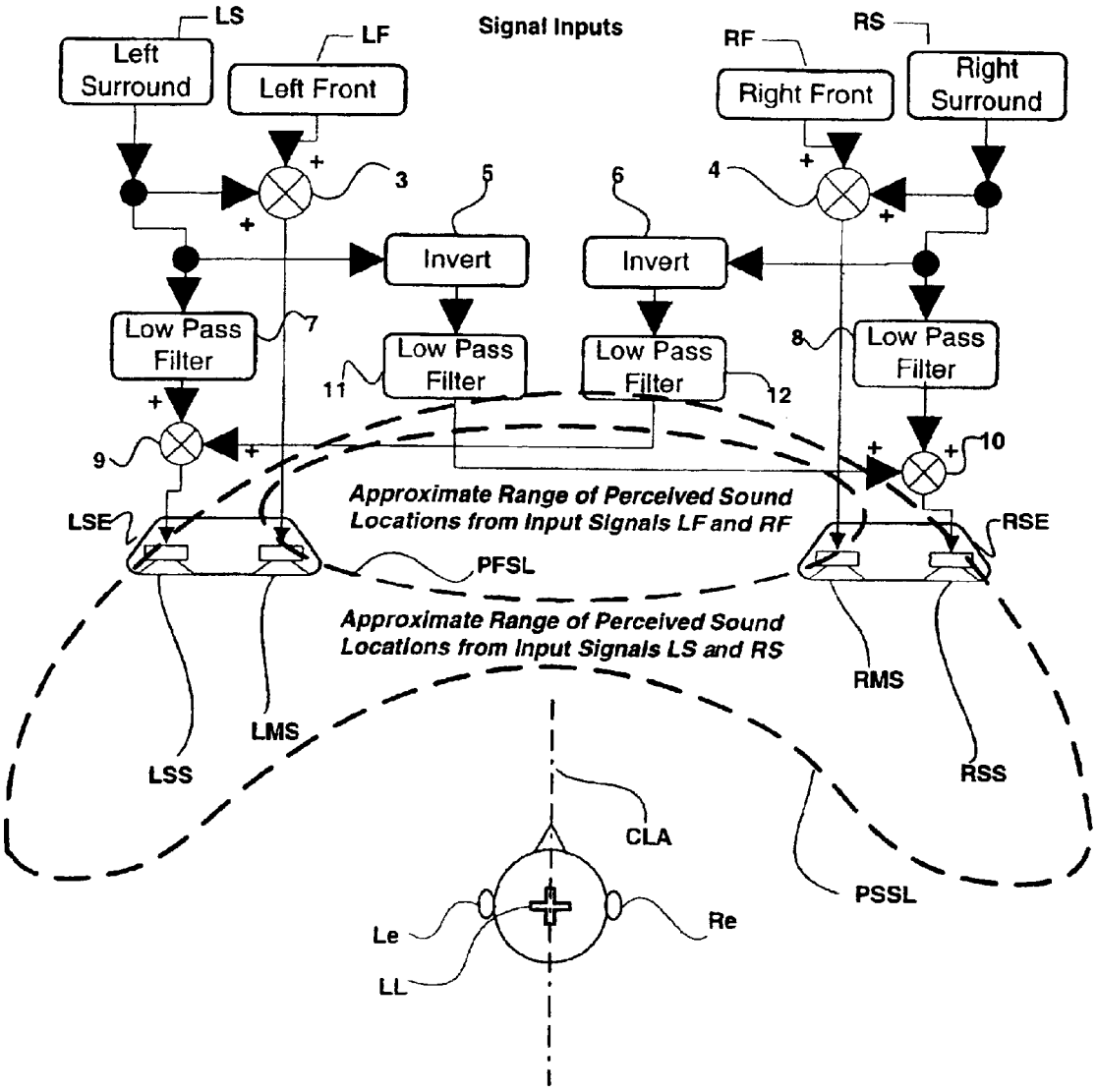

FIG. 19 is a diagram showing a eighth embodiment of the present invention.

Figure 20:
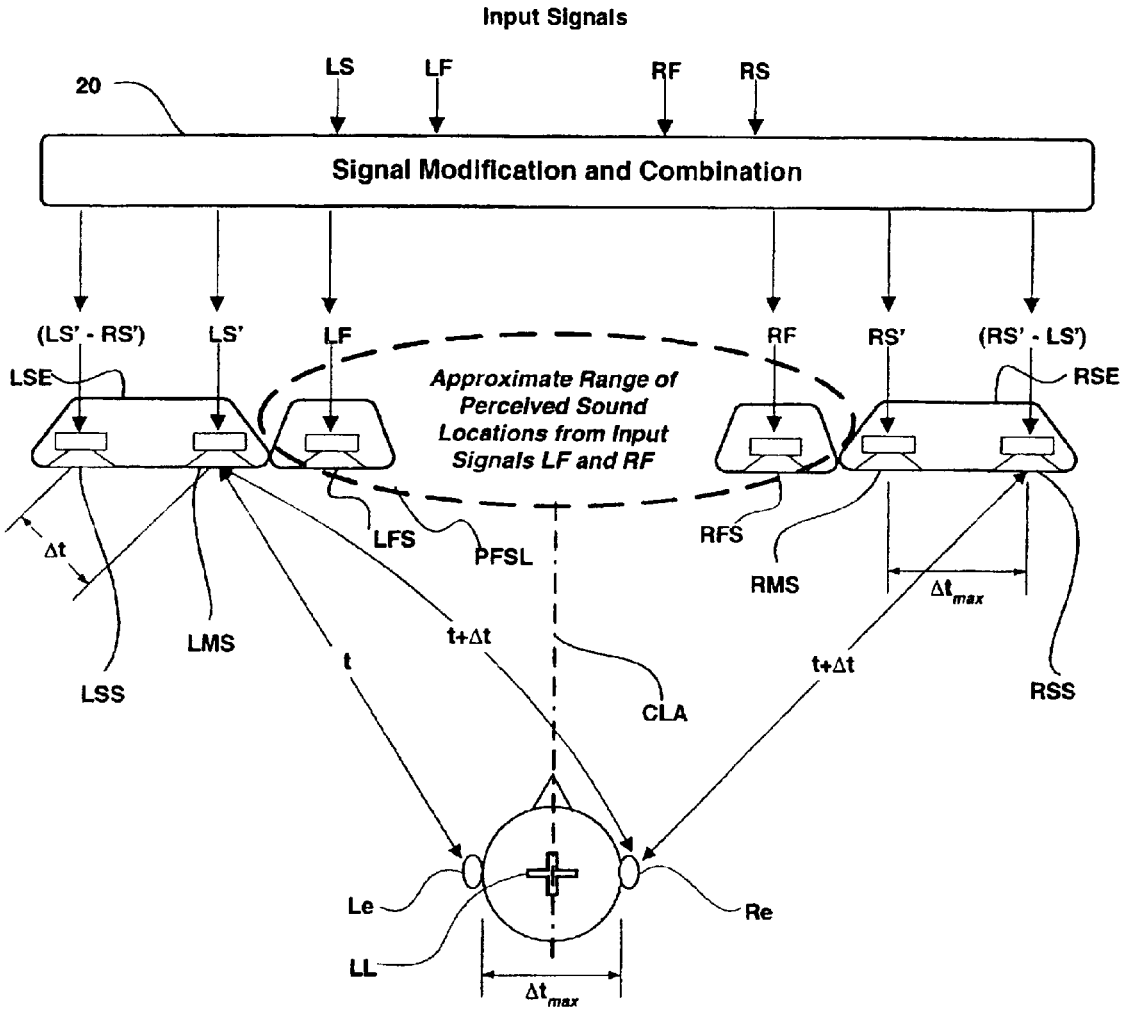

FIG. 20 is a diagram showing the signal combinations of a ninth embodiment of the present invention.

Figure 21:
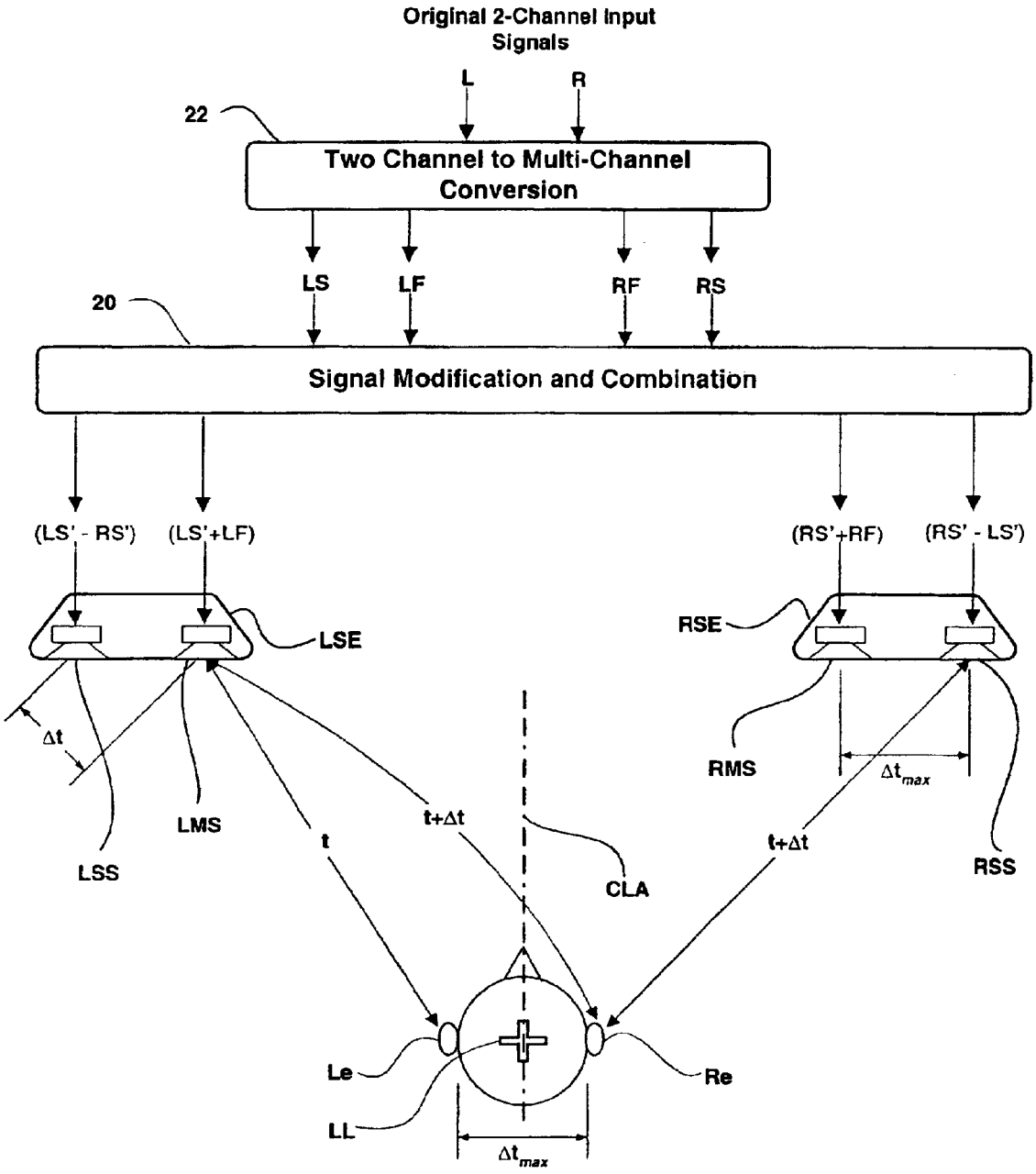

FIG. 21 is a diagram showing a tenth embodiment of the present invention.

DETAILED DESCRIPTION OF THE INVENTION

Preferred embodiments of the present invention are now described with reference to the figures where like reference characters/numbers indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention.

Figure 2:
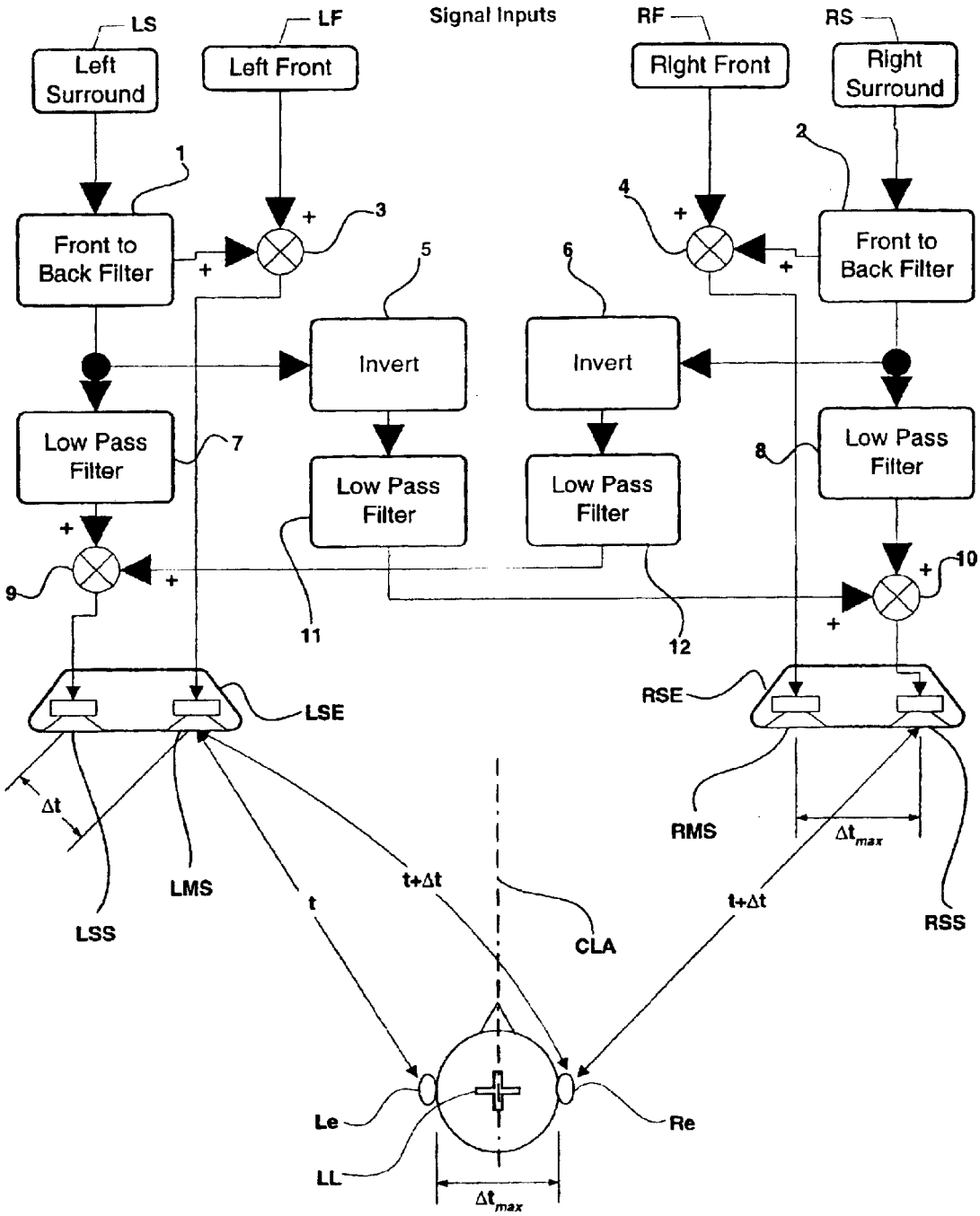
Figure 2A:
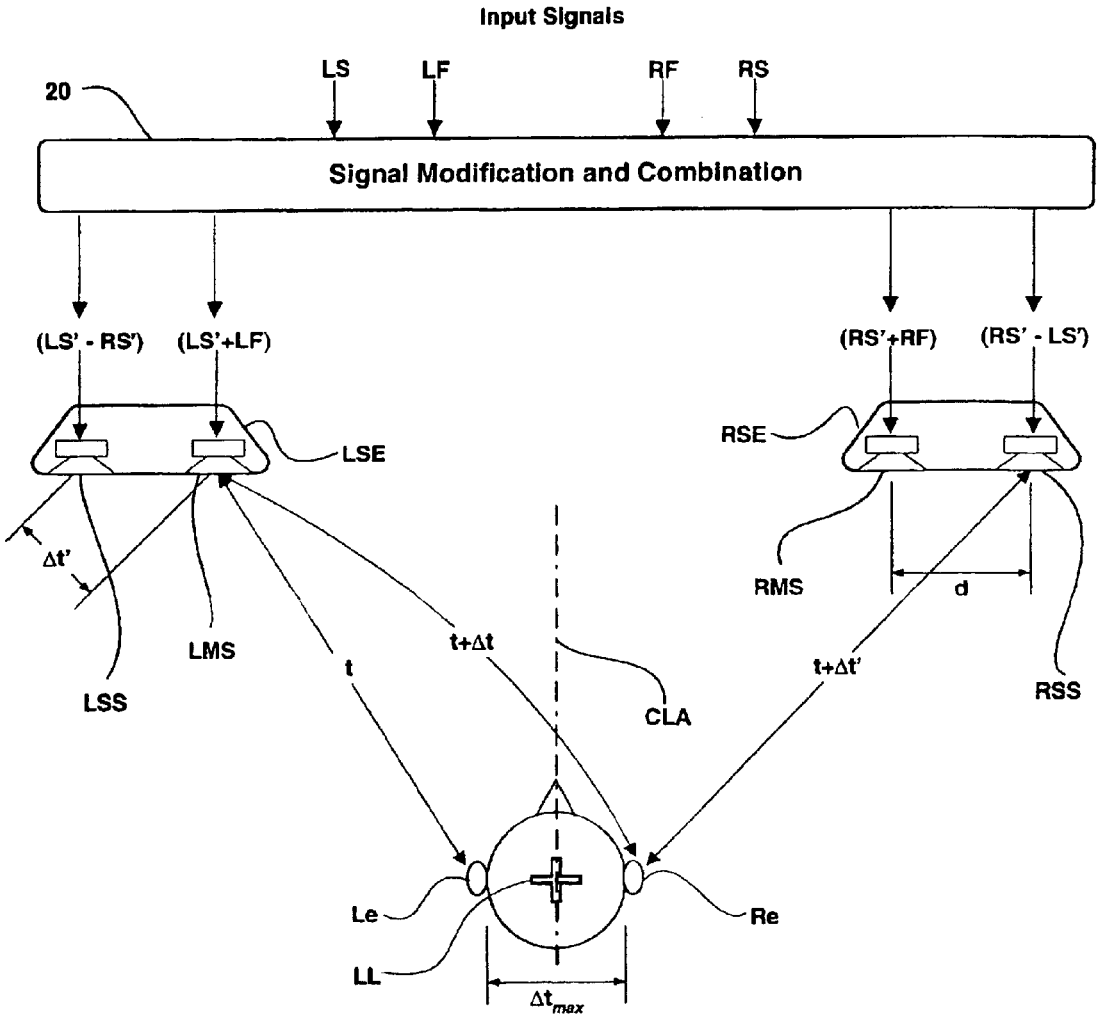

FIG. 2 and FIG. 2*a* show a first preferred embodiment of the present invention. Referring to FIG. 2, four audio signal inputs, for example only and not by way of limitation, corresponding to signal channels of a surround sound system are provided. It is understood that these may be any four audio input signals. However, for purposes of clarity and consistency these signals will be referred to herein as left surround signal LS; left front signal LF; right front signal RF; and right surround signal RS. Left and right loudspeaker enclosures, LSE and RSE are also provided. Left loudspeaker enclosure LSE contains at least one left main speaker LMS and at least one left sub-speaker LSS. Right loudspeaker enclosure RSE contains at least one right main speaker RMS and at least one right sub-speaker RSS. As is well known by those skilled in the art unmodified audio signals reproduced by a pair of of loudspeakers, such as in a typical stereo audio system, are perceived by a listener siting in front of the speakers as originating from a range of sound locations between the two loud speakers. There fore, sounds produced only by main left and right loudspeakers LMS and RMS are perceived by a listener located at principle listening location LL as originating from a range of sound locations approximately between and bounded by the actual locations of left and right main loudspeakers LMS and RMS.

As shown in FIG. 2, a listener located at principle listening location LL has a left ear Le and a right ear Re. The midpoint between the left ear Le and the right ear Re is located along a central listening axis CLA. As noted in U.S. Pat. No. 4,489,432, incorporated in its entirety by reference herein, the right and left ear locations are separated by a maximum interaural sound distance of $\Delta t_{max}$. As also explained in U.S. Pat. No. 4,489,432, and shown in FIG. 2, sound distance t is the time for sound from the left main speaker LMS to reach the left ear Le and sound distance t+Δt is the time for sound from the left main speaker LMS to reach the right ear Re. Similarly, sound distance t is also the time required for sound from right main speaker RMS to reach right ear Re and sound distance t+Δt is also the time for sound from the right main speaker RMS to reach the left ear Le In similar fashion, t+Δt is also the time for sound from the right sub-speaker RSS to reach the right ear Re, and the time for sound from the left sub-speaker LSS to reach the left ear Le.

Referring again to FIG. 2, left surround signal LS passes through front-to-back filter 1 and is combined with left front signal LF in adder 3. The combined signal is then transmitted to left main speaker LMS. Similarly, right surround signal RS passes through front-to-back filter 2 and is combined with right front signal RF in adder 4. The combined signal is then transmitted to right main speaker RMS.

Figure 3:
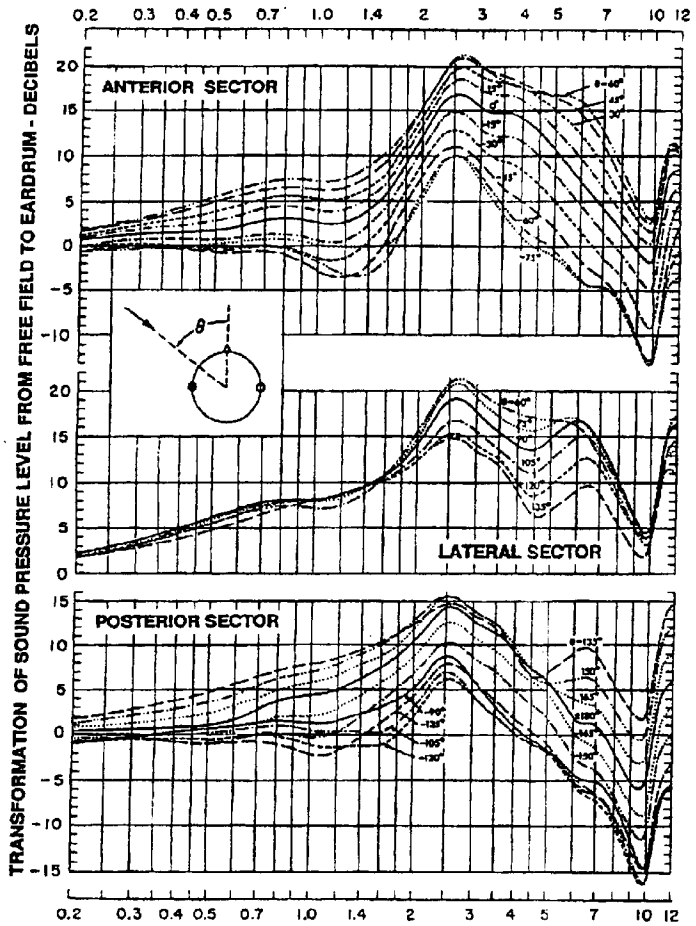
FIG. 3 shows a family of frequency response curves of sounds incident from various angular directions.
Figure 4:
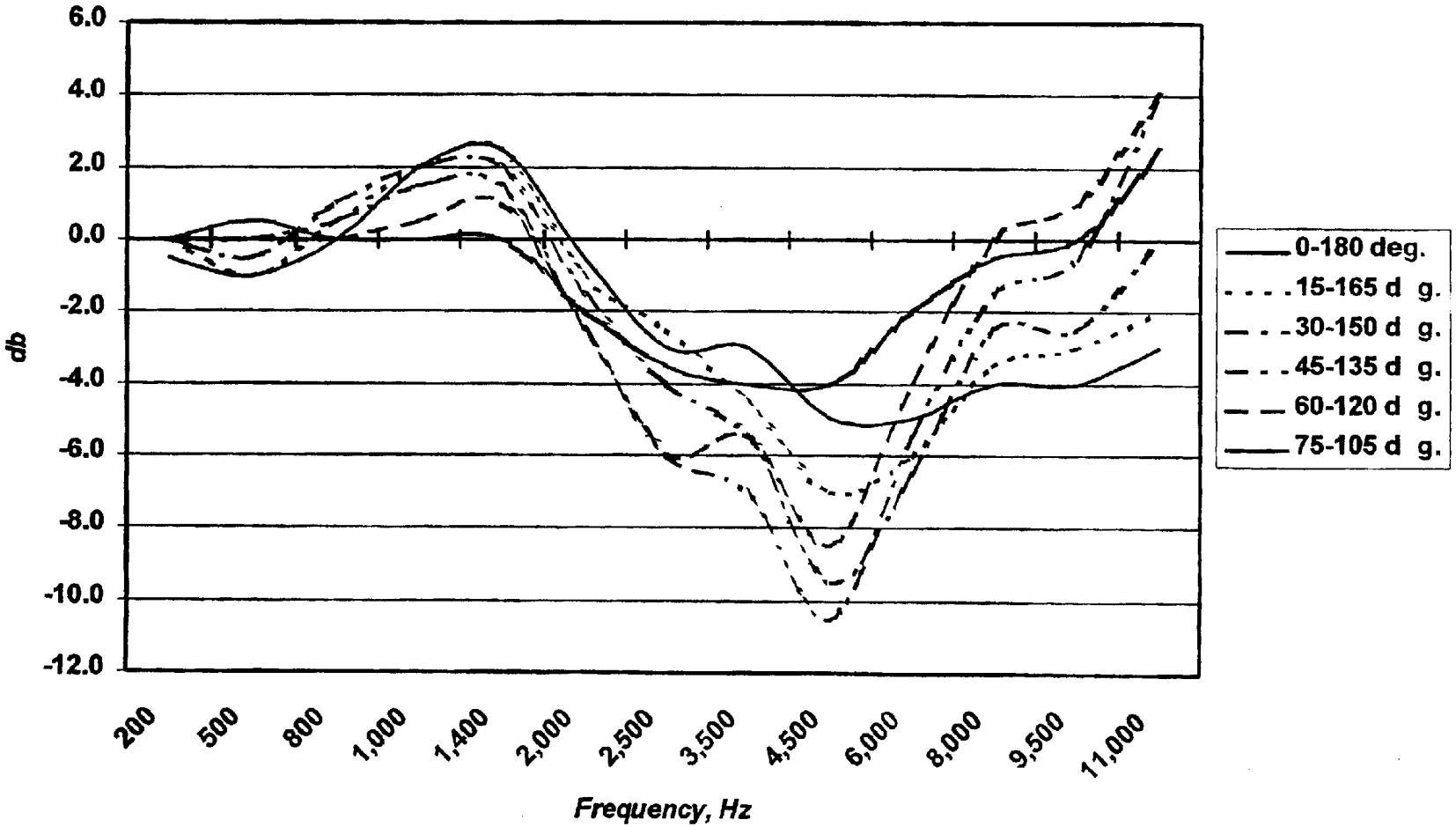
FIG. 4 shows a family of frequency response curves showing frequency response differences between sounds incident from in front of a listener and behind the listener, at the near ear of the listener.

Front-to-back filters 1 and 2 modify the surround signals LS and RS such that, at the listeners ears and over a certain frequency range, they will approximate the frequency response of sound signals as if they originated from the rear of the listener, even though they are being projected from the front of the listener. This modification is explained with reference to FIGS. 3 to 6. FIG. 3 shows a family of frequency response curves representing the frequency response at the ear drum of a listener relative to free field conditions for sounds arriving from different angular sound locations in the horizontal plane. FIG. 4 shows another family of frequency response curves calculated by subtracting the frequency response from FIG. 3 for sounds arriving at the listener's nearest ear of sound locations in front of the listener from the frequency response for sounds arriving from a mirror image sound location behind the listener. For example, referring to FIG. 3, subtracting the curve for sounds arriving at the listeners left ear at an angle of 45 degrees, in front of the listener, from the curve for sounds arriving at the left ear at an angle of 135 degrees, behind the listener, produces the curve labeled "45–135 deg." in FIG. 4. Thus, with the front-to-back filters 1 and 2 of FIG. 2 having the approximate characteristics of, for example, the front-to-back frequency response curve from FIG. 4 labeled "45–135 deg." and left and right main speakers LMS and RMS located approximately 45 degrees to either side of central listening axis CLA, a listener located at the principle listening location LL will perceive approximately the same frequency response for surround signals LS and RS at the ear drum of the respective nearest ear as if these sounds were originating at sound locations behind the listener mirror imaged to the actual sound locations of LMS and RMS in front of the listener from which the surround signals LS and RS are actually emanating.

Figure 5:
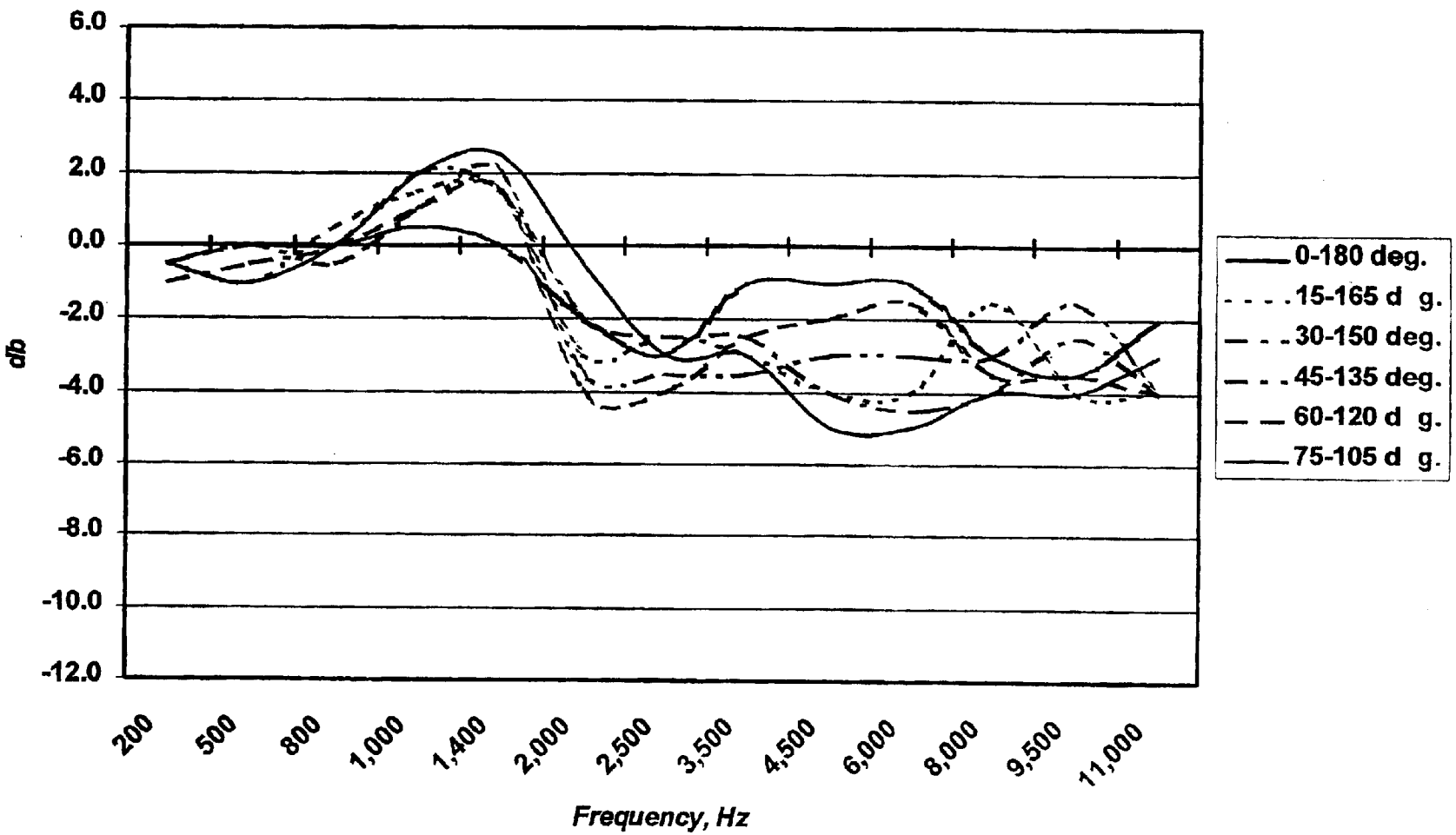
FIG. 5 shows a family of frequency response curves showing frequency response differences between sounds incident from in front of a listener and behind the listener, at the far ear of the listener.

FIG. 5 shows a similar family of front-to-back frequency response curves calculated by subtracting the frequency response shown in FIG. 3 for sounds arriving at the listener's farthest ear of sound locations in front of the listener, from the frequency response for sounds arriving from mirror image sound locations behind the listener. Application of front-to-back filters with these characteristics to sounds arriving at the listener's farthest ear from actual sound locations in front of the listener will duplicate the frequency response at the listener's farthest car drum of a sound arriving from a mirror image sound location behind the listener. For example, referring again to FIG. 3, subtracting the curve for sounds arriving at the listeners left ear at an angle of minus 45 degrees, in front of the listener, from the curve for sounds arriving at the left ear at an angle of minus 135 degrees, behind the listener, produces the curve labeled "45–135 deg." in FIG. 5. Thus, with front-to-back filters 1 and 2 of FIG. 2 having the approximate characteristics of, for example the front-to-back frequency response curve from FIG. 5 labeled "45–135 deg." and left and right main speakers LMS and RMS, located approximately 45 degrees to either side of central listening axis CLA, a listener located at principle listening location LL will perceive approximately the same frequency response for surround signals LS and RS at the car drum of the respective farthest ear as if the sound were located at sound locations behind the listener mirror imaged to the actual sound locations of LMS and RMS in front of the listener from which the surround signals LS and RS are actually emanating.

Figure 6:
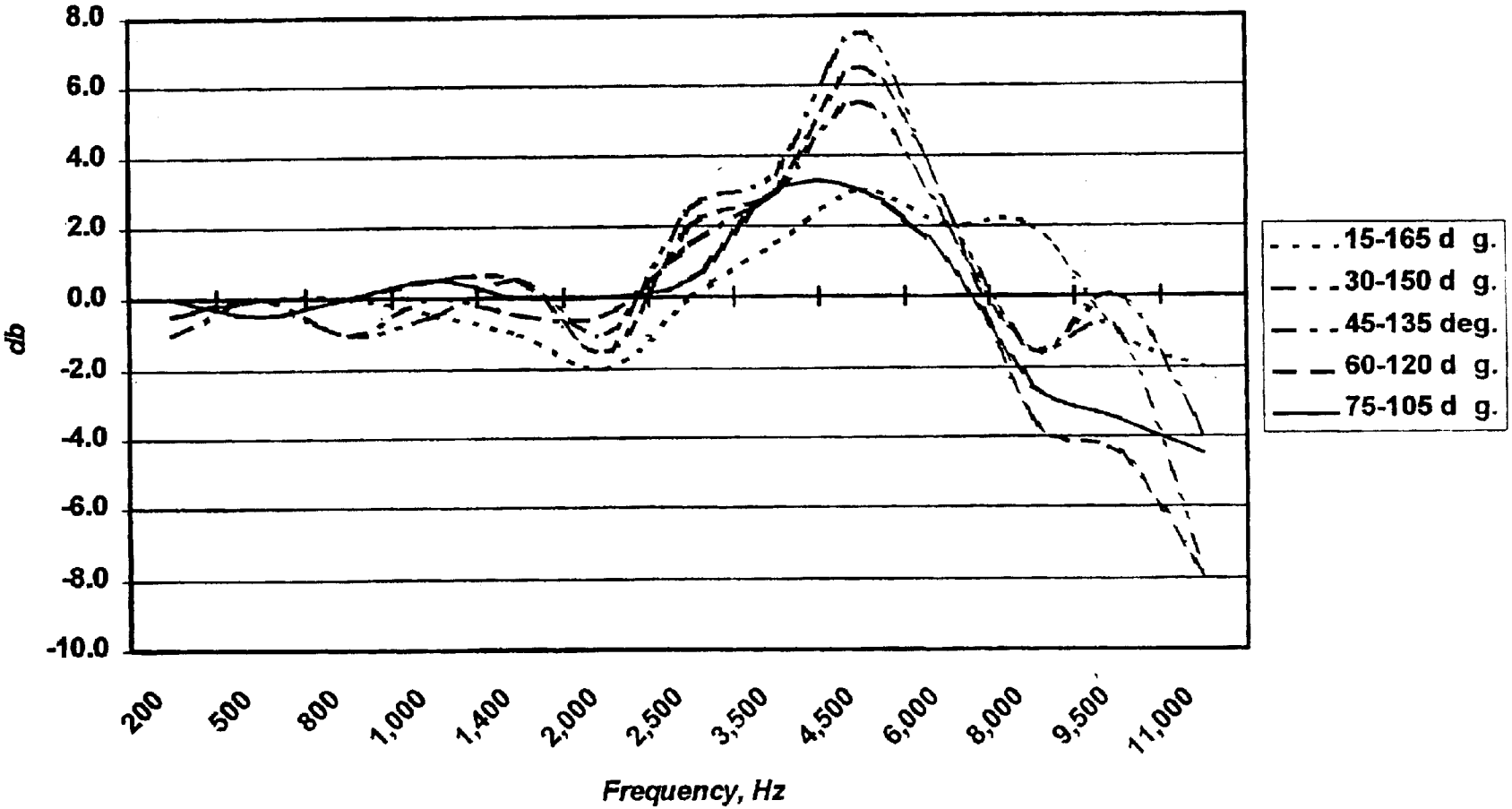
FIG. 6 shows a family of frequency response curves representing the differences between the front-to-back curves for the near ear shown in FIG. 4 and the front-to-back curves for the far ear shown in FIG. 5 for each mirror image front to back pair of sound locations.
Figure 7:
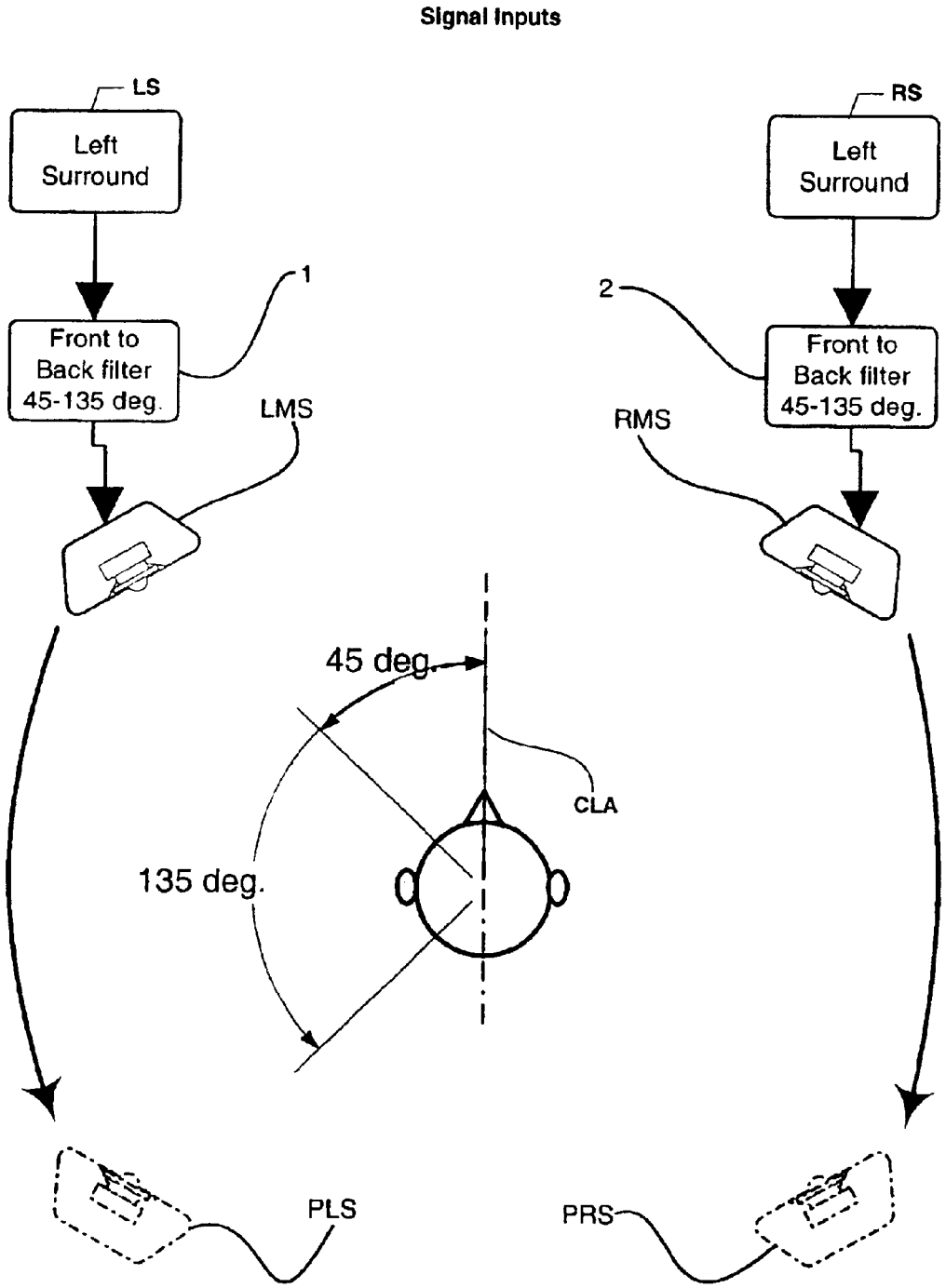
FIG. 7 is a schematic diagram showing perceived rear sounds at a point location behind the listener.

FIG. 6 shows a family of frequency response curves representing the differences between the front-to-back curves for the near ear shown in FIG. 4 and the front-to-back curves for the farthest ear shown in FIG. 5 for each mirror image front to back pair of sound locations. It can be seen by inspection of FIG. 6 that the front-to-back curves for the near ear and far ear are substantially the same up to a frequency of approximately 2,500 Hz. It can also be seen by inspection of FIG. 4 and FIG. 5 that the front-to-back frequency response curves for both the near ear and the far ear are very similar up to a frequency of approximately 2,500 Hz for sound locations approximately between 30 degrees and 60 degrees either side of central listening axis CLA in front of the listener. If front-to-back filters 1 and 2 have the approximate characteristics of, for example the front-to-back frequency response curve from FIG. 4 labeled '45–135 deg.' up to an approximate frequency of 2,500 Hz, then a listener located at the principle listening location LL will perceive approximately the same frequency response up to approximately 2,500 Hz at both ear drums for signals modified by said front-to-back filters 1 and 2 as if the sound were located at sound locations behind the listener mirror imaged to the actual sound locations of left and right main speakers LMS and RMS in front of the listener for locations of left and right main speakers LMS and RMS approximately between 30 degrees and 60 degrees to either side of the central listening axis CLA. As shown in FIG. 7 if the input signals to front-to-back filters 1 and 2 are, for example, the left and right surround signals LS and RS, the listener will perceive that the left and right surround signals LS and RS are being produced by loudspeakers located at mirror image locations phantom left and right speakers PLS and PRS behind the listener.

Therefore, in this first embodiment the front-to-back filters 1 and 2 of FIG. 2 may have characteristics which limit the frequency range to below approximately 2,500 Hz and which have approximately the frequency response of the curve labeled "45–135 deg." in FIG. 4 for frequencies below approximately 2,500 Hz. As noted above and as shown in FIG. 6, because front-to-back frequency response curves are very similar below approximately 2,500 Hz over a range of angular locations and for both near and farthest ear, even if the speakers are not located at exactly 45 degrees from the central listening axis CLA, the front-to-back filters 1 and 2 will still cause the listener to perceive that sounds-are coming from mirror image locations behind the listener, as shown in FIG. 7. Notwithstanding the foregoing discussion, experiments have shown that in some implementations of the present invention it is desirable for the frequency response of front-to-back filters 1 and 2 to extend substantially above 2,500 Hz. It has also been found that, in some implementations it is desirable to include a band emphasis of approximately plus 4 db to plus 8 db at a frequency of approximately 12 kHz.

Referring again to FIG. 2, after passing through front-to-back filter 1, left surround signal LS passes through an inverter 5 and a low pass filter 11. It then passes through an adder 10, in which it is combined with right surround signal RS, which has passed through front-to-back filter 2 and low pass filter 8 such that the resulting combined signal is composed of a modified left surround signal LS' subtracted from a modified right surround signal RS'. The combined signal is then transmitted to right sub-speaker RSS, located in right speaker enclosure RSE. Similarly, after passing through front-to-back filter 2, right surround signal RS passes through an inverter 6 and a low pass filter 12. It then passes through an adder 9, in which it is combined with left surround signal RS, which has passed through front-to-back filter 1 and low pass filter 7 such that the resulting combined signal is composed of a modified right surround signal RS' subtracted from a modified left surround signal LS'. The combined signal is then transmitted to left sub-speaker LSS located in left speaker enclosure LSE. Low pass filters 7, 8, 11 and 12 may have characteristics limiting the frequency response to below approximately 1 kHz, as disclosed in U.S. Pat. No. 4,630,298 generally for the purpose of stabilizing the apparent sound locations, improving tolerance to movements of the listener's head, improving the illusion of apparent sound locations for listeners not located at the principle listening location LL, and allowing greater tolerance in the location of the main and sub-speakers. However, in some implementations of the present invention it is desirable for said low pass filters to have frequency response extending substantially beyond 1 kHz or to select one cutoff frequency for low pass filters 7 and 8, and a different cutoff frequency for low pass filters 11 and 12. In one specific implementation of this embodiment of the present invention low pass filters 7 and 8 have a frequency response extending to approximately 5 kHz and low pass filters 11 and 12 have a frequency response extending up to approximately 1.8 kHz.

In accordance with this first embodiment, FIG. 2*a* shows the general composition of the modified and combined signals transmitted to each speaker where the prime designation, ', denotes that the original audio input signal has been suitably modified by signal modification and combination means 20. It will be understood that within the scope of the present invention and as shown in FIG. 2*a* that any suitable means may be employed to achieve the appropriate signal modifications and combinations. In addition and as discussed above, experiments have shown that within the scope of the present invention, many variations to the specific signal modifications herein described function to provide an acceptable surround sound illusion from loudspeakers located only in front of the listener. The specific signal modifications described herein are by way of example only and not of limitation.

Figure 1:
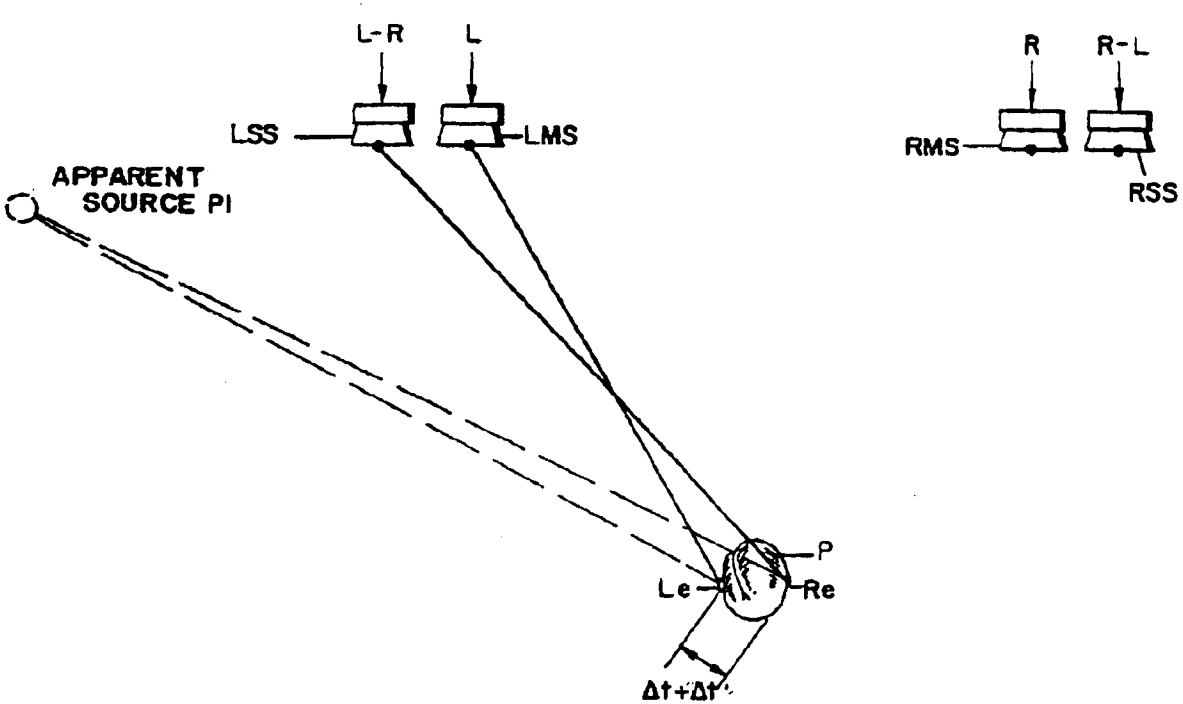
Prior Art Fig. 1
Figure 8:
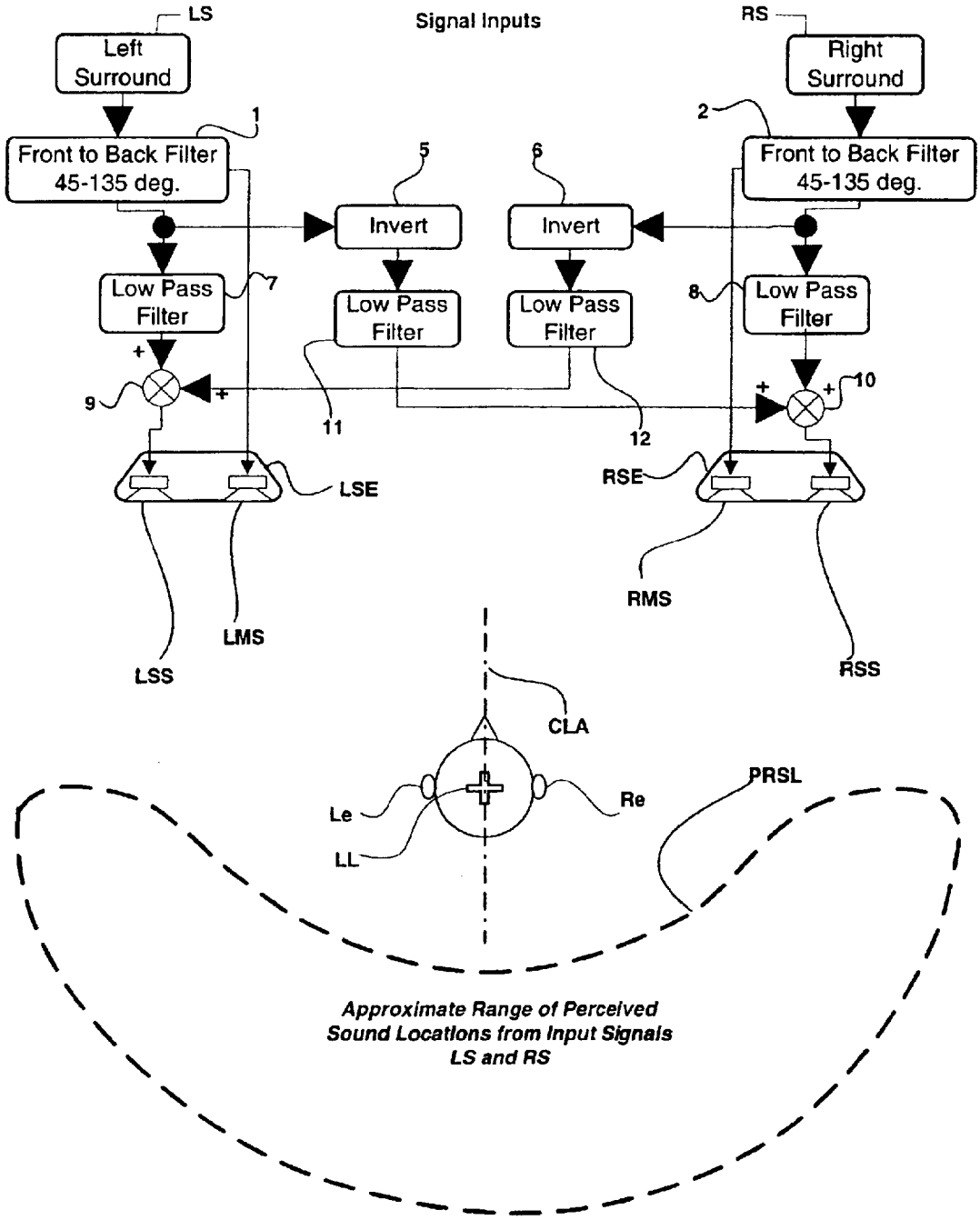
FIG. 8 is a schematic diagram showing perceived apparent sound locations over a broad range of locations begin the listener when utilizing the present invention.

In this first embodiment, left sub-speaker LSS and right sub-speaker RSS are positioned relative to left main speaker LMS and right main speaker RMS and to the listener according to the teachings of U.S. Pat. Nos. 4,489,432; 4,497,064; 4,569,074 and 4,630,298 for the purpose of canceling IAC and producing a realistic acoustic field extending beyond the loudspeaker locations. As shown in prior art FIG. 1, and discussed in the above-referenced U.S. Patents, the left and right sub-speakers LSS and RSS may be located on a common speaker axis with left and right main speakers LMS and RMS. However, as also discussed in the above-referenced U.S. Pat. No. 4,497,064, the sub-speakers may be placed in any location that produces the correct time delay relative to the respective main speakers for sounds aiming at the listener's ears. As shown in FIG. 2 and discussed in U.S. Pat. Nos. 4,489,432; 4,497,064; and 4,569,074 in the case that the main and sub-speakers are located along a common speaker axis the preferred spacing between the respective main and sub-speakers on each side is approximately equal to the maximum interval sound $\Delta t_{max}$ up to approximately 150% of $\Delta t_{max}$ resulting in a corresponding variation in the inter-speaker delay Δf' without departing from the spirit and function of the present invention. As shown in prior art FIG. 1, the methods disclosed in U.S. Pat. Nos. 4,489,432; 4,497,064; 4,569,074 and 4,630,298 are capable of creating apparent sound locations in a range of up to approximately 90 degrees left and right of central listening axis CLA in front of the listener from two audio input signals such as are present in a normal stereo recording. As previously described, in the first embodiment of the present invention, front-to-back filters 1 and 2 of FIG. 2 are selected to transform the frequency response of sound locations in front of the listener to approximate the frequency response at both of the listener's ear drums of sound locations at mirror image locations behind the listener over a defined frequency range. The methods disclosed in U.S. Pat. Nos. 4,489,432; 4,497,064; 4,569,074 and 4,630,298 modified as specified herein and in combination with the aforementioned signal manipulations will therefore create the illusion of sound locations in a range of approximately 90 degrees left and right of the central listening axis behind the listener from left and right surround input signals LS and RS. Referring to FIG. 8, the signal paths for left and right surround signals LS and RS, only are shown along with the approximate range of perceived rear sound locations PRSL from left and right surround signals LS and RS. Referring to FIG. 2, sounds from left front and right front, input signals LF and RF will be perceived to remain at approximate sound locations of loudspeakers LMS and RMS respectively. Therefore in this embodiment of the present invention utilizing loudspeakers located only in front, the listener will perceive apparent sound locations in front and to the rear similar to a conventional surround sound loudspeaker system typically utilizing four actual loudspeakers positioned in front and behind the listener. In addition, this embodiment of the present invention offers advantages over conventional surround sound loudspeaker systems and prior art methods for generating phantom rear channels such as U.S. Pat. Nos. 5,799,094; 6,052,470 and 5,579,396 in that the listener will perceive apparent sound locations PRSL over a broad range of locations behind them, as shown in FIG. 8, which depend mainly on the composition of the recorded signals rather than apparent rear sound locations which are confined to specific apparent rear speaker locations, such as shown in FIG. 7, which depend mainly on front speaker location. Furthermore, the present invention enjoys advantages in the flexibility of listener location over purely electronic prior art methods for generating a surround sound illusion. The use of main and sub-speakers according to the present invention eliminates the need for a specific fixed distance relationship between the main speakers and the listener and also between the two main speakers. Additionally, experiments have shown that this arrangement in combination with the signal modifications described herein is capable of generating a broad range of apparent sound locations for listeners located generally in the area in front of the speakers but not located at the principle listening location LL. Experiments have also shown that listeners located even further from the principle listening location LL may still experience a pleasing surround sound illusion but with much less specific localization of apparent sound locations.

Figure 2B:
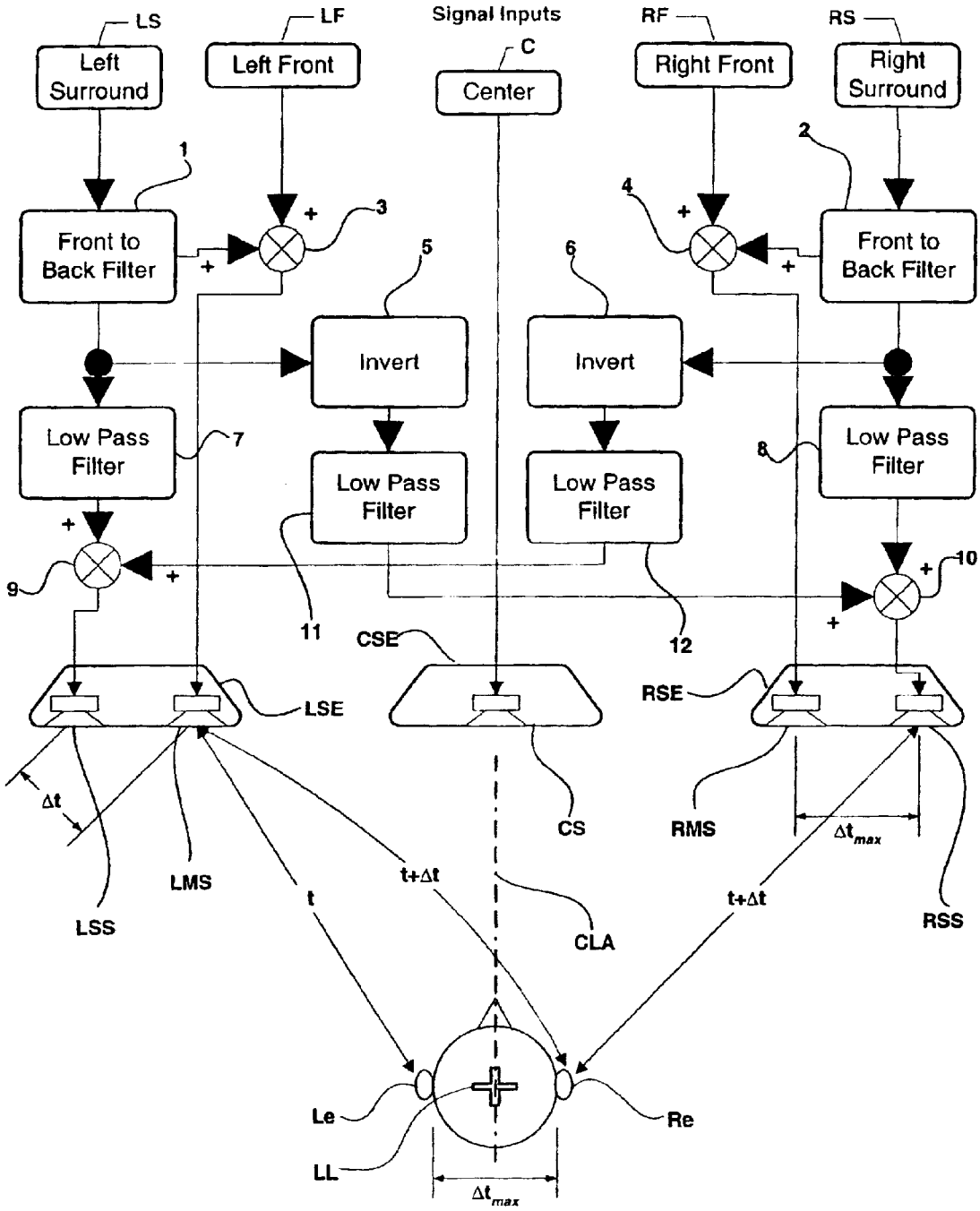

Referring briefly to FIG. 2*b*, a variation of this first embodiment is shown which is identical to that shown in FIG. 2 except that a fifth audio input signal, such as a center channel signal in a surround sound system C is provided. A center channel loudspeaker enclosure CSE which contains at least one center loudspeaker CS is also provided. The center signal input C for the center channel is transmitted to center loudspeaker CS. The sounds produced by center loudspeaker CS are perceived by a listener located at the principle listening location LL as originating from the approximate sound location of center loudspeaker CS. It will be understood by those skilled in the art that in accordance with this and other embodiments of the present invention a surround sound experience from front located loudspeakers may be created using only four audio input signals, as shown in FIG. 2 and FIG. 2*b*, and that the presence of a fifth audio input signal, such as the center channel signal typically found in a surround sound system, is optional and not required.

Figure 9:
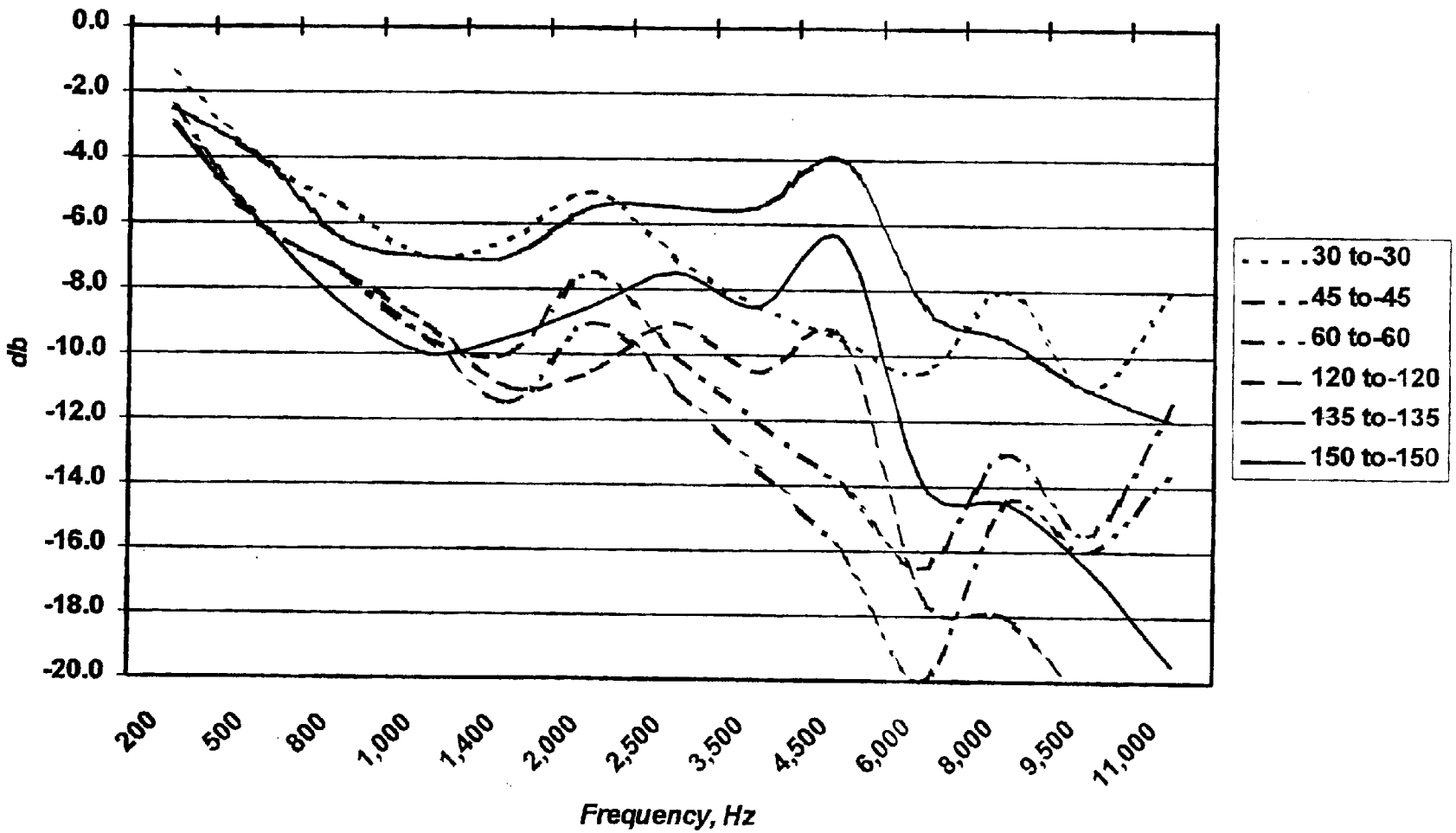
FIG. 9 shows a family of curves calculated by subtracting the frequency response shown in FIG. 3 for sounds arriving from a particular direction at the listener's nearest ear from the frequency response for sounds arriving from the same direction at the listener's farthest ear.
Figure 10:
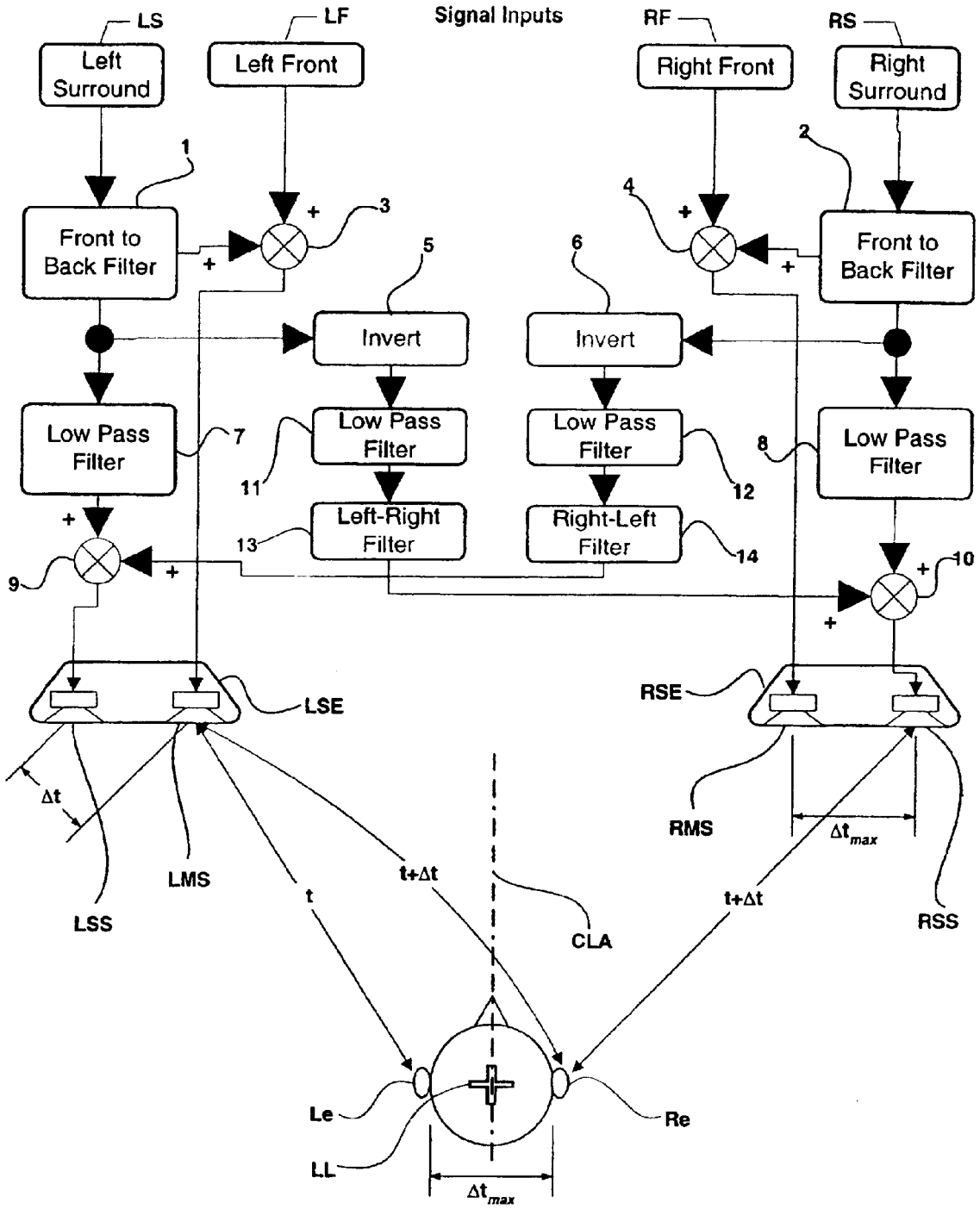
FIG. 10 is a diagram showing a second embodiment of the present invention.

A second embodiment of the present invention is shown in FIG. 10. This second embodiment is the same as the first embodiment described with respect to FIG. 2 and FIG. 2*a*, except for the addition of left-right filter 13 and right-left filter 14. Left-right filter 13 is added to the path of left surround signal LS after it has passed through front-to-back filter 1, inverter 5, and low pass filter 11, and prior to being combined with right surround signal RS in adder 10. Similarly, right-left filter 14 is added to the path of right surround signal RS after it has passed through front-to-back filter 2, inverter 6, and low pass filter 12, and prior to being combined with left surround signal LS in adder 9. The purpose of left-right filter 13 and right-left filter 14 will be explained with respect to FIG. 9, discussed below.

FIG. 9 shows a family of curves calculated by subtracting the frequency response shown in FIG. 3 for sounds arriving from a particular direction at the listener's nearest ear from the frequency response for sounds arriving from the same direction at the listener's farthest ear. Therefore, these curves represent the change in frequency response of a sound as it passes across the listener's head from left to right or right to left. By inspection of FIG. 9 it can be seen that these curves are similar in shape and magnitude up to a frequency of approximately 2,000 Hz. Referring again to this second embodiment of the present invention as shown in FIG. 10, left-right filter 13 may have approximately the characteristics of, for example, the curve of FIG. 9 labeled, "45 to −45". Thus, the inverted and low-passed left surround signal produced by right sub-speaker RSS for the purpose of canceling IAC will better match the frequency response of the in-phase left surround signal produced by left main speaker LMS when it reaches the listener's right ear Re, and will, therefore, be more effective in canceling LAC. Right-left filter 14 may have similar characteristics such that the effectiveness of IACC at the listener's left ear Le, will be similarly improved. The result will be an improved perception of apparent sound locations over a broad range of locations behind the listener.

Figure 11:
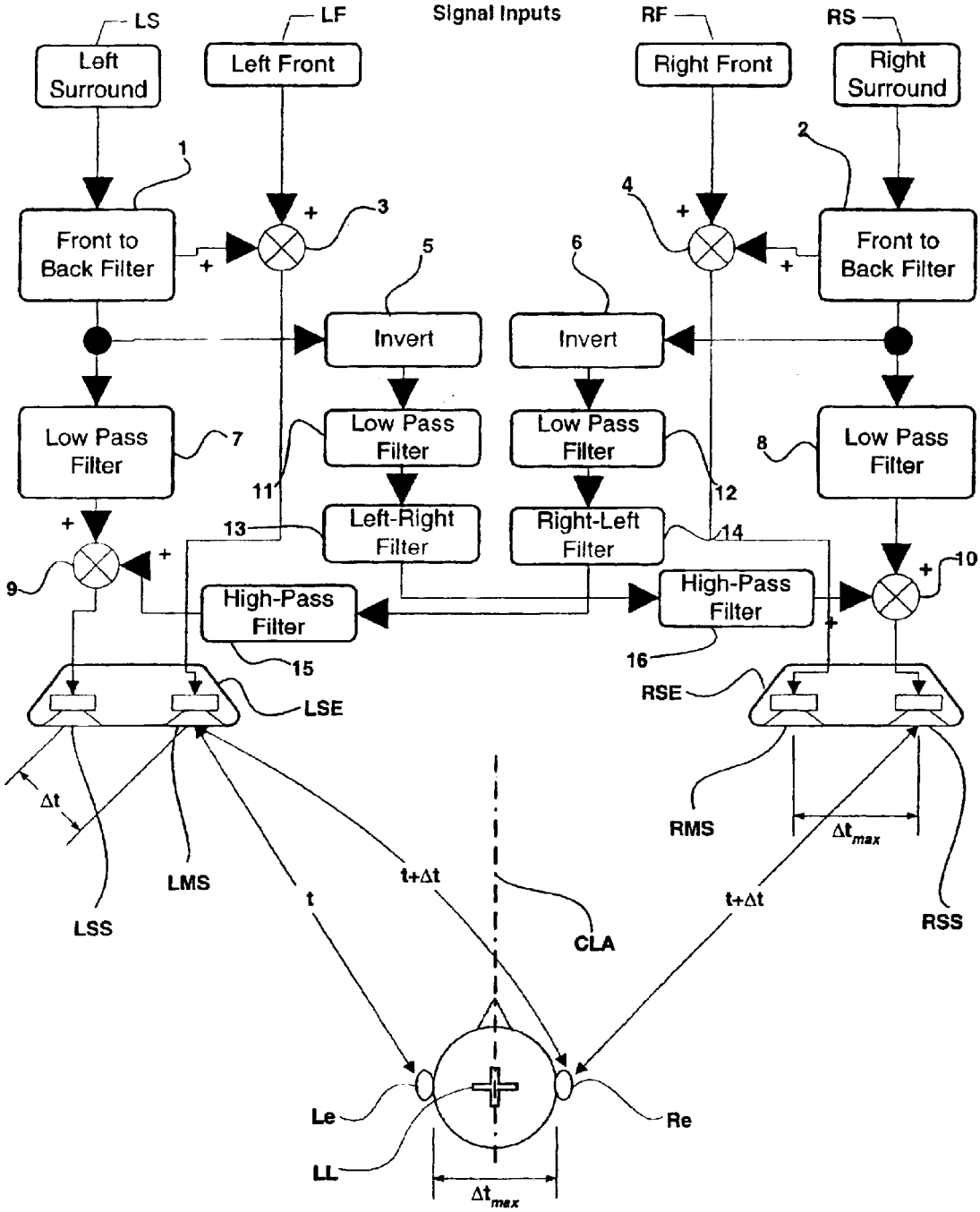
FIG. 11 is a diagram showing a third embodiment of the present invention.

A third embodiment of the present invention is shown in FIG. 11. The third embodiment is identical to the second embodiment described with respect to FIG. 10, except that high-pass filters 15 and 16 are added. High-pass filter 15 is added to the path of left surround signal LS after it has passed through front-to-back filter 1, inverter 5, low-pass filter 11, and left-right filter 13, and prior to being combined with right surround signal RS in adder 10. Similarly, high-pass filter 16 is added to the path of right surround signal RS after it has passed through front-to-back filter 2, inverter 6, low pass filter 12, and right-left filter 14, prior to being combined with left surround signal LS in adder 9. In general, there is very little difference between left and right surround signals LS and RS at low frequencies. Referring to FIG. 10, the signal manipulations described in the second embodiment have little effect on the signals below a frequency of approximately 150 Hz except that one component of these signals is inverted before being added to the opposite side surround signal by adders 9 and 10 and transmitted to their respective sub speakers LSS and RSS. Therefore the low frequency response of these components will substantially cancel each other when they are added together leaving a signal composed mainly of mid and higher frequency information to be reproduced by sub speakers LSS and RSS. As discussed previously, directional hearing on the basis of ITD's is effective only down to a frequency of approximately 150 Hz. Referring again to FIG. 11, frequencies below approximately 150 Hz may be eliminated from the inverted left and right surround signal paths through the use of high-pass filters 15 and 16, without compromising the effectiveness of IACC. Therefore the low frequency response of the in-phase portion of the left and right surround signals will not be canceled and the low frequency performance of the system, overall, will be improved.

Figure 12:
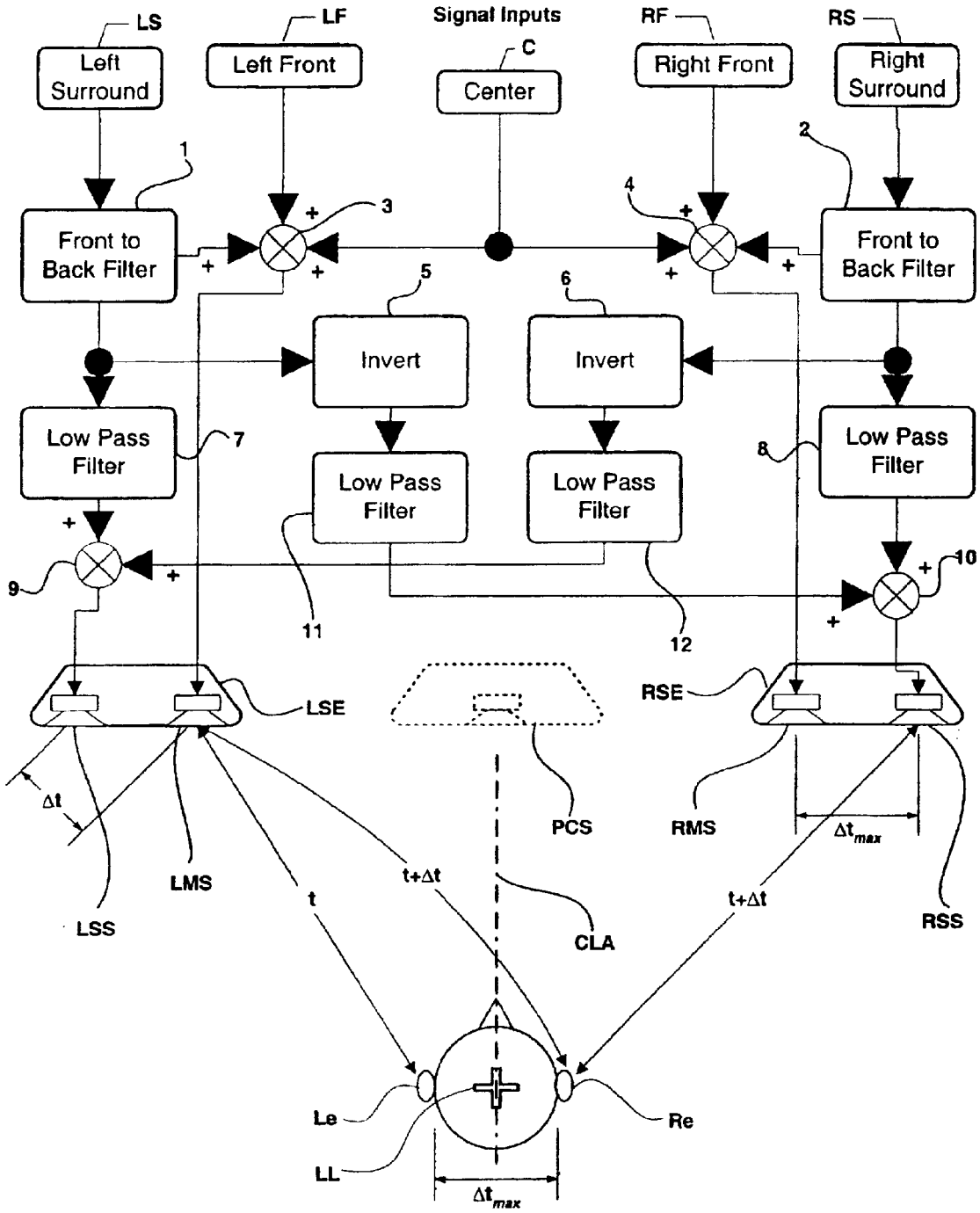
FIG. 12 is a diagram showing a fourth embodiment of the present invention.

A fourth embodiment of the present invention is shown in FIG. 12. In this embodiment of the present invention the center loudspeaker is eliminated from the first embodiment shown in FIG. 2*b* and described above. Referring to FIG. 12, center signal input C is split and added to left and right front signals LF and RF and to modified left and right surround signals LS and RS, by adders 3 and 4. The resulting signal is transmitted to left and right main speakers LMS and RMS, respectively. The listener will, therefore, perceive a phantom center sound location PCS directly in front and on the central listening axis CLA for sounds from the center signal input C, without the use of a center loudspeaker. It will be understood that within the scope of the present invention the technique described above for generating a phantom center sound location and eliminating the physical center speaker may be employed as part of any of the other embodiments described herein.

A fifth embodiment of the present invention is shown in FIG. 13 and FIG. 13*a*. This embodiment of the present invention is similar to the first embodiment described with respect to FIG. 2, except that left and right front signals LF and RF are applied to the left and right sub speakers LSS and RSS through certain filters and signal manipulations so as to cancel IAC and create an expanded range of perceived front sound locations in addition to the perceived range of rear sound locations previously discussed in the first embodiment. Referring to FIG. 13, left front signal LF is combined with left surround signal LS by adder 3 after left surround signal LS has been modified by front-to-back filter 1. Similarly, right front signal RF is combined with right surround signal RS by adder 4 after right surround signal RS has been modified by front-to-back filter 2. The combination of left front signal LF and modified left surround signal LS is transmitted to left main speaker LMS and is also subtracted from the combination of right front signal RF and modified right surround signal RS by first inverting the combined left front plus modified left surround signals with inverter 5 and, after passing through optional low pass filter 11, is added by adder 10 to the combined right front plus modified right surround signals which have further passed through optional low-pass filter 8. The resulting difference signal is transmitted to the right sub-speaker RSS. Similarly, the combination of right front signal RF and modified right surround signal RS is transmitted to right main speaker RMS and is also subtracted from the combination of left front signal LF and modified left surround signal LS by first inverting the combined right front plus modified right surround signals with inverter 6 and, after passing through optional low pass filter 12, is added by adder 11 to the combined left front plus modified left surround signals which have further passed through optional low-pass filter 7. The resulting difference signal is transmitted to the left sub-speaker LSS. As discussed above, the effect of front-to-back filters 1 and 2 in the signal path of left and right surround signals LS and RS causes them to be perceived as located behind the listener. The absence of these filters in the path of left and right front signals LF and RF causes them to be perceived as located in front of the listener. The arrangement of main and sub-speakers, LMS, RMS, LSS and RSS, combined with the signal manipulations shown in FIG. 13 causes the listener to perceive an expanded range of sound locations for all of the signals applied to main and sub-speakers with sound locations from left and right front signals LF and RF perceived as in front of the listener and sound locations from left and right surround signals LS and RS perceived as being behind the listener as shown in FIG. 14.

In accordance with this fifth embodiment FIG. 13*a* shows the general composition of the modified and combined signals transmitted to each speaker where the prime designation, ', denotes that the original audio input signal has been suitably modified by signal modification and combination means 20. It will be understood that within the scope of the present invention and as shown in FIG. 13*a* that any suitable means may be employed to achieve the appropriate signal modifications and combinations.

A sixth embodiment of the present invention is shown in FIG. 15. In this embodiment of the present invention, a signal format detection device 22 is added to the method shown in FIG. 13 and described above as the fifth embodiment and adders 17 and 18 are replaced by switches 19 and 19*a*. When signal format detection device 22 determines that at least four audio input signals are present, switches 19 and 19*a* are activated to select the signal paths originating with left and right surround signals LS and RS. In this case the result is as described above in the first embodiment. When signal format detection determines that left and right surround signals LS and RS are not present, switches 19 and 19*a* are activated to select the signal path originating with left and right front signals LF and RF. In this case the result is an expanded range of perceived sound locations in front of the listener for reproduced sounds associated with left and right front signals LF and RF as shown in FIG. 16. It will be understood that signal format detection and suitable switching may be used to reroute any pair of input signals for the purpose of creating a broader perceived range of sound locations either in front or behind the listener.

A seventh embodiment of the present invention is shown in FIG. 17. In this embodiment of the present invention a rear center channel signal input RC is added to the embodiment described with respect to FIG. 11. Rear center channels have become increasingly common in so called "6.1" surround sound systems. Rear center signal RC is modified by passing through center front-to-back filter 21 and is then combined on one side with left front signal LF and left surround signal LS by adder 3 before being passed to left main speaker LMS and on the other side with right front signal RF and right surround signal RS by adder 4 before being passed to right main speaker RMS. If the center front-to-back filter 21 has characteristics, for example, approximately similar to front-to-back filters 1 and 2, the rear center channel signal emanating from left main speaker LMS and right main speaker RMS will be perceived by a listener located at principle listening location LL as having frequency response approximately the same as if these sounds were originating behind the listener at locations mirror image to the locations of left and right main speakers LMS and RMS shown as locations PLMS and PRMS in a simplified diagram FIG. 18. Since the phantom rear sounds from locations PLMS and PRMS are the same, a listener located at listening location LL will perceive the rear center signal as emanating from a phantom rear center location PRCL directly behind the listening location as also shown in FIG. 18.

An eighth embodiment of the present invention is similar to the first embodiment as shown in FIG. 2 except that no front-to-back filters are used. Referring to FIG. 19, the signal paths for left and right surround signals LS and RS are shown without front-to-back filters. All other signal paths are the same as shown in FIG. 2. In the absence of front-to-back filters, left and right surround signals LS and RS will be perceived by a listener located at principle listening location LL as emanating from a range of locations in front of the listener indicated in FIG. 19 as PSSL. As in the first embodiment left and right front signals LF and RF are fed to left and right main speakers LMS and RMS. As a result a listener located at listening location LL will perceive left and right front signals LF and RF as originating from a range of sound locations PFSL between said left and right main speakers LMS and RMS while left and right surround signals LS and RS will be perceived emanating from a range of locations in front of the listener PSSL extending beyond the locations of the loudspeakers. Experiments have shown that this arrangement produces an acceptable pseudo surround sound experience due to the broad range of perceived sound locations for surround signals LS and RS even though they are perceived as emanating from in front and to the sides of the listener rather than to the rear.

A ninth embodiment of the present invention is shown in FIG. 20. This ninth embodiment is similar to the first embodiment except that separate left and right front speakers LFS and RFS are provided for reproducing left and right front signals LF and RF. Left and right front speakers LFS and RFS may be placed anywhere in front of the listener and receive only the left and right front signals LF and RF respectively. As a result, a listener located at the principle listening location LL will perceive that left and right front signals LF and RF are emanating from a range of sound locations PFSL between the left and right front speakers LFS and RFS in front of the listener. In this ninth embodiment signal modifications and combinations are applied to left and right surround signals LS and RS by signal modification and combination means 20 to produce the signal combinations for each speaker as shown in FIG. 20. Signal modifications may include any of the modifications discussed previously in other embodiments for example only and not by way of limitation, front-to-back filters, left-to-right filters, low-pass filters or high-pass filters, such that the listener perceives a broad range of apparent sound locations for left and right surround signals LS and RS either in front or to the rear of the listener according to the signal modifications employed.

A tenth embodiment of the present invention is shown in FIG. 21. This tenth embodiment is similar to the first embodiment described in FIG. 2 and FIG. 2*a* except that the at least four input signals LS, LF, RF and RS are derived from two original input signals L and R such as are typically found in a stereo audio system. In this tenth embodiment two channel to multi-channel conversion means 22 are provided which process the two original input signals L and R in such as way as to provide at least four signal outputs LS, LF, RF and RS. Many methods for accomplishing the two channel to multi-channel conversion, such as Dolby™ Pro-Logic™, are known to those skilled in the art. These at least four signal outputs LS, LF, RF and RS are then used as inputs to the signal modification and combination means 20 described previously in the other embodiments. As a result, a listener located at the principle listening location LL will perceive a surround sound experience from only front located loudspeakers and from only two original input channels L and R similar what is described in the other embodiments. It will be understood that within the scope of the present invention the two channel to multi-channel conversion means 22 may also produce a fifth channel, such as a center channel C or a sixth channel, such as a rear center channel RC, which would also be used as inputs to the signal modification and combination means 20 described previously in the other embodiments.

In addition to these embodiments it will be understood that many other variations are possible within the scope of the present invention. For example the enhancements described above as the second and third embodiments may be combined with the fourth, fifth and sixth embodiments. Or, the phantom center channel method described in the fourth embodiment may be combined with any of the other embodiments. It should also be understood that within the scope of the present invention, the input signals are not limited to left surround, right surround, left front, right front and center, such as are available in a typical audio surround sound system, but may be any combination of at least two signals where it is desirable to create a broad range of perceived sound locations either in front of or behind a listener.

What is claimed is:

1. An audio reproduction system comprising:

a first audio input signal, a second audio input signal, a third audio input signal, and a fourth audio input signal;

a left main speaker and a right main speaker disposed respectively at left and right main speaker locations spaced along a speaker axis defined as a line passing through said left and right main speaker locations, with a listening area comprising the general area in front of the left and right main speaker locations such that the left main speaker location lies to the left and the right main speaker location lies to the right when viewed from the listening area, wherein said left and right main speakers reproduce sound associated with signals received by said left and right main speakers;

a left sub-speaker and a right sub-speaker disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations and are spaced a distance d from the respective left and right main speaker locations such that the distance d is in the range from approximately 50% to 150% of the average spacing between a person's ears as measured in a straight line through the head, wherein said left and right sub-speakers reproduce sound associate with signals received by them; and signal modification and combination means, wherein said signal modification and combination means comprises, means for modifying and combining the first audio input signal with the second audio input signal and transmitting the combination of said modified first audio input signal and said second audio input signal to said left main speaker, means for modifying and combining the fourth audio input signal with the third audio input signal and transmitting the combination of said modified fourth audio input signal and said third audio input signal to said right main speaker, means for subtracting said modified fourth audio input signal from said modified first audio input signal and transmitting the resulting difference signal to said left sub-speaker, and means for subtracting said modified first audio input signal from said modified fourth audio input signal and transmitting the resulting difference signal to said right sub-speaker, wherein sound reproduced by the system that is associated with said second and third audio input signals is perceived by a listener located in the listening area whose head is oriented generally toward the speaker locations to originate from a range of sound locations approximately between said left and right main speakers, and wherein sound reproduced by the system that is associated with said first and fourth audio input signals is perceived by a listener located in the listening area whose head is oriented generally toward the speaker locations to originate from a broad range of sound locations extending beyond the locations of said left and right sub-speakers.

2. The audio reproduction system of claim 1 further comprising:

a fifth audio input signal;

a center front speaker located between the left and right main speaker locations, wherein said center front speaker reproduces sound associated with signals received by it; and means for transmitting said fifth audio input signal to said center front speaker;

wherein sound reproduced by the system associated with said fifth audio input signal is perceived by a listener located in the listening area whose head is oriented generally toward the speaker locations to originate from approximately the location of said center front speaker.

3. The audio reproduction system of claim 1 or 2, wherein the distance d between said respective main and sub-speakers is approximately equal to the average ear spacing.

4. The audio reproduction system of claim 1, wherein said signal modification and combination means further includes a first front-to-back filter for modifying the first audio input signal and a second front-to-back filter for modifying the fourth audio input signal such that the reproduced sound associated with said first and fourth audio input signals is perceived by a listener located in the listening area whose head is oriented generally toward the speaker locations to originate from a broad range of sound locations extending beyond the locations of said left and right sub-speakers including areas behind the listener.

5. The audio reproduction system of claim 1 or 2, wherein said first audio input signal, said second audio input signal, said third audio input signal, and said fourth audio input signal correspond to rear left, front left, front right, and rear right signals of a surround sound audio system.

6. The audio reproduction system of claim 4, wherein the first and second front-to-back filters are band limited to below approximately 2,500 Hz.

7. The audio-reproduction system of claim 4, wherein the first and second front-to-back filters include band emphasis at approximately 12 kHz.

8. The audio reproduction system of claim 1 or 2, wherein the signal modification and combination means further includes a first low-pass filter for modifying the portion of the modified first audio input signal transmitted to the left sub-speaker and a second low-pass filter for modifying the portion of the modified fourth audio input signal transmitted to the right sub-speaker, wherein the apparent sound locations of sound reproduced by the system associated with said first and fourth audio input signals are perceived by a listener located in the listening area to be more stable and more tolerant of movements of the listener's head.

9. The audio reproduction system of claim 8, wherein said first and second low-pass filters limit frequency response to below approximately 5 kHz.

10. The audio reproduction system of claim 8, wherein said first and second low-pass filters limit frequency response to below approximately 1.8 kHz.

11. The audio reproduction system of claim 8, wherein said first and second low-pass filters limit frequency response to below approximately 1 kHz.

12. The audio reproduction system of claim 8, wherein the signal modification and combination means further includes a third low-pass filter for modifying that portion of the modified first audio input signal subtracted from the modified fourth audio input signal and a fourth low-pass filter for modifying that portion of the modified fourth audio input signal subtracted from the modified first audio input signal, wherein the apparent sound locations of sound reproduced by the system associated with said first and fourth audio input signals are perceived by a listener located in the listening area to be more stable and more tolerant of movements of the listener's head.

13. The audio reproduction system of claim 2, wherein the signal modification and combination means further includes:

a first high-pass filter for modifying the portion of the modified first audio input signal which is subtracted from the modified fourth audio input signal prior to transmission to the right sub-speaker; and a second high-pass filter for modifying the portion of the modified fourth audio input signal which is subtracted from the modified first audio input signal prior to transmission to the left sub-speaker;

wherein the resulting signals received by the left and right sub-speakers have low-frequency content primarily composed of information only from the first and fourth audio input signals, respectively.

14. The audio reproduction system of claim 1, further comprising a fifth audio input signal, wherein the signal modification and combination means further includes means for combining said fifth audio input signal with the signals being received by the left and right main speakers, and wherein in addition to the signals specified in claim 1, the left and right main speakers also receive approximately equal quantities of said fifth audio input signal, and wherein sound reproduced by the system associated with said fifth audio input signal is perceived by a listener located in the listening area to originate approximately from a location equidistant between the left and right main speakers.

15. The audio reproduction system of claim 14, further comprising a sixth audio input signal, wherein the signal modification and combination means further includes, a front-to-back filter for modifying the sixth audio input signal, and means for combining the modified sixth audio input signal with the signals being received by the left and right main speakers, wherein in addition to the signals specified in claim 14, the left and right main speakers also receive approximately equal quantities of said modified sixth audio input signal, and wherein sound reproduced by the system associated with said sixth audio input signal is perceived by a listener located in the listening area to originate from a location generally behind the listener.

16. The audio reproduction system of claim 4, wherein said signal modification and combination means further comprises:

means for combining the second audio input signal with the first audio input signal after modification of said first audio input signal by a first front-to-back filter;

means for combining the third audio input signal with the fourth audio input signal after modification of said fourth audio input signal by a second front-to-back filter;

means for subtracting the combination of the modified fourth audio input signal and the third audio input signal from said combination of the modified first audio input signal and the second audio input signal and for transmitting the resulting difference signal to said left sub-speaker; and means for subtracting the combination of the modified first audio input signal and the second audio input signal from said combination of the modified fourth audio input signal and the third audio input signal and for transmitting the resulting difference signal to said right sub-speaker, wherein sound reproduced by the system associated with said second and third audio input signals is perceived by a listener located in the listening area whose head is oriented generally toward the speaker locations to originate from a broad range of sound locations generally in front of the listener location and extending beyond said left and right sub-speakers; and wherein sound reproduced by the system associated with said first and fourth audio input signals is perceived by a listener located in the listening area whose head is oriented generally toward the speaker locations to originate from a broad range of sound locations extending beyond the locations of said left and right sub-speakers and including the area behind the listener.

17. The audio reproduction system of claim 16, wherein the signal modification and combination means further includes:

a first low-pass filter for modifying the portion of the combined modified first and second audio input signal transmitted to the left sub-speaker; and a second low-pass filter for modifying the portion of the combined modified third and fourth audio input signal transmitted to the right sub-speaker, wherein the apparent sound locations of sound reproduced by the system associated with said first, second, third and fourth audio input signals are perceived by a listener located in the listening area whose head is oriented generally toward the speaker locations to be more stable and more tolerant of movements of the listener's head.

18. The audio reproduction system of claim 17, wherein said first and second low-pass filters limit frequency response to below approximately 5 kHz.

19. The audio reproduction system of claim 17, wherein said first and second low-pass filters limit frequency response to below approximately 1.8 kHz.

20. The audio reproduction system of claim 17, wherein said first and second low-pass filters limit frequency response to below approximately 1 kHz.

21. The audio reproduction system of claim 17, wherein the signal modification and combination means further includes:

a third low-pass filter for modifying that portion of the combined modified first and second audio input signal subtracted from the combined modified third and fourth audio input signal; and a fourth low-pass filter for modifying that portion of the combined modified third and fourth audio input signal subtracted from the combined modified first and second audio input signal, wherein the apparent sound locations of sound reproduced by the system associated with said first, second, third and fourth audio input signals are perceived by a listener located in the listening area whose head is oriented generally toward the speaker locations to be more stable and more tolerant of movements of the listener's head.

22. The audio reproduction system of claim 16, wherein the signal modification and combination means further includes:

a first high-pass filter for modifying that portion of the combined modified first and second audio input signals which is subtracted from the combined modified third and fourth audio input signals prior to reproduction by the right sub-speaker; and a second high-pass filter for modifying that portion of the combined modified third and fourth audio input signals which is subtracted from the combined modified first and second audio input signals prior to reproduction by the left sub-speaker, wherein the resulting signal received by the left sub-speaker has low-frequency content primarily composed of information only from the combined modified first and second audio input signals, a nd wherein the resulting signal received by the right sub-speaker has low-frequency content primarily composed of information only from the combined and modified third and fourth audio input signals.

23. The audio reproduction system of claim 16, further comprising a fifth audio signal input, wherein the signal modification and combination means further includes means for combining said fifth audio input signal with the signals being received by the left and right main speakers;

wherein in addition to the signals specified in claim 16, the left and night main speakers also receive approximately equal quantities of said fifth audio input signal, and wherein sound reproduced by the system associated with said fifth audio input signal is perceived by a listener located in the listening area whose head is oriented generally toward the speaker locations to originate approximately from a location equidistant between the left and right main speakers.

24. The audio reproduction system of claim 23, further comprising a sixth audio input signal, wherein the signal modification and combination means includes a front-to-back filter for modifying the sixth audio input signal; and means for combining the modified sixth audio input signal with the signals being received by the left and right main speakers;

wherein in addition to the signals specified in claim 23, the left and right main speakers also receive approximately equal quantities of said modified sixth audio input signal; and wherein sound reproduced by the system associated with said sixth audio input signal is perceived by a listener whose head is located generally at the listening location to originate from a location generally behind the listener.

25. An audio reproduction system comprising:

a first audio input signal, a second audio input signal, a third audio input signal, and a fourth audio input signal;

a left main speaker and a right main speaker disposed respectively at left and right main speaker locations spaced along a speaker axis defined as a line passing through said left and right main speaker locations, with a listening area comprising the general area in front of the left and right main speaker locations such that the left main speaker location lies to the left and the right main speaker location lies to the right when viewed from the listening area, wherein said left and right main speakers reproduce sound associated with signals received by them;

a left front speaker and a right front speaker located respectively at left and right front speaker locations generally in front of a listener in the listening area, wherein said left and right front speakers reproduce sound associated with signals received by them;

a left sub-speaker and a right sub-speaker disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations and are spaced a distance d from the respective left and right main speaker locations such that the distance d is in the range from approximately 50% to 150% of the average spacing between a person's ears as measured in a straight line through the head, wherein said left and right sub-speakers reproduce sound associated with signals received by them; and signal modification and combination means, wherein said signal modification and combination means comprises, means for transmitting the second audio input signal to the left front speaker and the third audio input signal to the right front speaker;

means for modifying the first audio input signal and transmitting the modified first audio input signal to said left main speaker, means for modifying fourth audio input signal and transmitting the modified fourth audio input signal to said right main speaker, means for subtracting the modified fourth audio input signal from the modified first audio input signal and transmitting the resulting difference signal to said left sub-speaker, and means for subtracting the modified first audio input signal from the modified fourth audio input signal and transmitting the resulting difference signal to said right sub-speaker, wherein sound reproduced by the system associated with said second and third audio input signals is perceived by a listener located in the listening area whose head is oriented generally toward the speaker locations to originate from a range of sound locations approximately between said left front speaker and said right front speaker, and wherein sound reproduced by the system that is associated with said first and fourth audio input signals is perceived by a listener located in the listening area whose head is oriented generally toward the speaker locations to originate from a broad range of sound locations extending beyond the locations of said left and right sub-speakers.

26. The audio reproduction system of claim 25, further comprising a fifth audio input signal, wherein the signal modification and combination means further includes means for combining said fifth audio input signal with the signals being received by said left front speaker and said right front speaker;

wherein in addition to the signals specified in claim 25, the left and right front speakers also receive and reproduce approximately equal quantities of said fifth audio input signal; and wherein sound reproduced by the system associated with said fifth audio input signal is perceived by a listener located in the listening area whose head is oriented generally toward the speaker locations to originate approximately from a location equidistant between the left and right front speakers.

27. The audio reproduction system of claim 26, further comprising a sixth audio input signal, wherein the signal modification and combination means further includes:

a front-to-back filter for modifying the sixth audio input signal; and means for combining the modified sixth audio input signal with the signals being received by the left and right front speakers;

such that in addition to the signals specified in claim 26, the left and right front speakers also receive approximately equal quantities of said modified sixth audio input signal; and such that the reproduced sound associated with said sixth audio input signal is perceived by a listener whose head is located generally at the listening location to originate from a location generally behind the listener.

28. The audio reproduction system of claim 1 or 16, further comprising:

means for accepting a two-channel audio input signal; and two channel to multi-channel conversion means for converting said two-channel audio input signal into a multi-channel audio output comprising at least four audio output signals; and means for transmitting said at least four audio output signals to the at least four audio signal inputs of the signal modification and combination means.

29. The audio reproduction system of claim 1 or 16, further comprising:

means for accepting a two-channel audio input signal;

a two channel to multi-channel converter for converting said two-channel audio input signal into a multi-channel audio output comprising five audio output signals;

means for transmitting four of the audio output signals to the four audio signal inputs of the signal modification and combination means of claim 1; and a center front speaker located in front of the listening location; wherein said fifth audio output signal is transmitted to and reproduced by said center front speaker;

such that the reproduced sound associated with said fifth audio output signal is perceived by a listener located in the listening area whose head is oriented generally toward the speaker locations to originate from approximately the location of said center front speaker.

30. The audio reproduction system of claim 1, further comprising:

signal format detection means for determining the format of the at least four audio input signals; and switching means for disconnecting the first and fourth audio input signals and for altering the signal path of the second and third audio input signals;

such that, upon determination that only the second and third audio input signals are active, said switching means operates to disconnect the first and fourth audio signals from the signal modification and combination means and to reconnect the second and third audio input signals to the signal modification and combination means in the locations previously occupied by the first and fourth audio input signals, respectively, so as to bypass any front-to-back filters in the new signal paths for the second and third audio input signals;

such that said second and third audio input signals are substituted for said first and fourth audio signals, respectively, in the difference signals transmitted to and reproduced by the left and right sub-speakers;

such that sound reproduced by the system associated with said second and third audio input signals is perceived by a listener located in the listening area whose head is oriented generally toward the speaker locations to originate from a broad range of sound locations extending beyond the locations of said left and right sub-speakers.

31. A method for producing phantom surround sound effect from a loudspeaker system located in front of a listener, comprising the steps of:

providing a left main speaker and a right main speaker disposed respectively at left and right main speaker locations spaced along a speaker axis defined as a line passing through said left and right main speaker locations, with a listening area comprising the general area in front of the left and right main speaker locations such that the left main speaker location lies to the left and the right main speaker location lies to the right when viewed from the listening area;

providing a left sub-speaker and a right sub-speaker disposes respectively at left and right sub-speaker locations, wherein the left and right sub-speaker locations lie approximately on the speaker axis such that the left and right sub-speaker locations as viewed from the listening area are located to the left and right respectively of the respective left and right main speaker locations and are spaced a distance d from the respective left and right main speaker locations such that the distance d is in the range from approximately 50% to 150% of the average spacing between a person's ears as measured in a straight line through the head;

modifying a first audio input signal and combining the modified first audio input signal with a second audio input signal, transmitting the combination of the modified first audio input signal and the second audio input signal to the left main speaker, and reproducing sound associated with the combination of the modified first audio input signal and the second audio input signal in the left main speaker;

modifying a fourth audio input signal and combining the modified fourth audio input signal with a third audio input signal, transmitting the combination of the modified fourth audio input signal and the third audio input signal to the right main speaker, and reproducing the sound associated with the combination of the modified fourth audio input signal and the third audio input signal in the right main speaker;

subtracting the modified fourth audio input signal from the modified first audio input signal, transmitting the resulting difference signal to the left sub-speaker, and reproducing sound associated with the difference signal in the left sub-speaker; and subtracting the modified first audio input signal from the modified fourth audio input signal, transmitting the resulting difference signal to the right sub-speaker, and reproducing sound associated with the difference signal in the right sub-speaker, wherein the reproduced sound associated with the second and third audio input signals is perceived by a listener located in the listening area whose head is oriented generally toward the speaker locations to originate from a range of sound locations approximately between said left and right main speakers, and wherein the reproduced sound associated with the first and fourth audio input signals is perceived by a listener located in the listening area whose head is oriented generally toward the speaker locations to originate from a broad range of sound locations extending beyond the locations of said left and right sub-speakers.

32. The method of claim 31 further comprising the steps of:

providing a center front speaker located between the left and right main speaker locations; and transmitting a fifth audio input signal to the center front speaker and reproducing sound associated with the fifth audio input signal in the center front speaker, wherein the reproduced sound associated with the fifth audio input signal is perceived by a listener located in the listening area whose head is oriented generally toward the speaker locations to originate from approximately the location of said center front speaker.

33. The method of claim 31 or 32, wherein the distance d between the respective main and sub-speakers is approximately equal to the average ear spacing.

34. The method of claim 31, wherein said step of modifying the first audio input signal comprises using a first front-to-back filter and said step of modifying the fourth audio input signal comprises using a second front-to-back filter, such that the reproduced sound associated with the first and fourth audio input signals is perceived by a listener located in the listening area whose head is oriented generally toward the speaker locations to originate from a broad range of sound locations extending beyond the locations of said left and right sub-speakers including areas behind the listener.

35. The method of claim 31 or 32, wherein the first audio input signal, the second audio input signal, the third audio input signal, and the fourth audio input signal correspond to front left, front right, rear left, and rear right signals of a surround sound audio system.

36. The method of claim 34, further comprising the step of band limiting the first and second front-to-back filters to below approximately 2,500 Hz.

37. The method of claim 34, wherein the first and second front-to-back filters include band emphasis at approximately 12 kHz.

38. The method of claim 31 or 32, further comprising the steps of:

limiting the frequency response of the portion of the modified first audio input signal transmitted to the left sub-speaker to below a certain frequency; and limiting the frequency response of the portion of the modified fourth audio input signal transmitted to the right sub-speaker to below a certain frequency;

wherein the apparent sound locations of the reproduced sound associated with the first and fourth audio input signals are perceived by a listener located in the listening area to be more stable and more tolerant of movements of the listener's head.

39. The method of claim 38, wherein the frequency response of the portion of the modified first and fourth audio input signals is limited to below approximately 5 kHz.

40. The method of claim 38, wherein the frequency response of the portion of the modified first and fourth audio input signals is limited to below approximately 1.8 kHz.

41. The method of claim 38, wherein the frequency response of the portion of the modified first and fourth audio input signals is limited to below approximately 1 kHz.

42. The method of claim 38, further comprising the steps of:

limiting the frequency response of the portion of the modified first audio input signal subtracted from the modified fourth audio input signal to below a certain frequency; and limiting the frequency response of the portion of the modified fourth audio input signal subtracted from the modified first audio input signal to below a certain frequency;

wherein the reproduced sound associated with the first and fourth audio input signals are perceived by a listener located in the listening area to be more stable and more tolerant of movements of the listener's head.

43. The method of claim 31 or 32, further comprising the steps of:

limiting the frequency response of the portion of the modified first audio input signal which is subtracted from the modified fourth audio input signal to above a certain frequency prior to transmission to the right sub-speaker; and limiting the frequency response of the portion of the modified fourth audio input signal which is subtracted from the modified first audio input signal to above a certain frequency prior to transmission to the left sub-speaker;

wherein the resulting signals received by the left and right sub-speakers have low-frequency content primarily composed of information only from the first and fourth audio input signals, respectively.

44. The method of claim 31, further comprising the step of:

combining a fifth audio input signal with the signals being received by the left and right main speakers such that, in addition to the signals specified in claim 31, approximately equal quantities of the fifth audio input signal are transmitted to and reproduced by the left and right main speakers;

wherein the reproduced sound associated with the fifth audio input signal is perceived by a listener located in the listening area to originate approximately from a location equidistant between the left and right main speakers.

45. The method of claim 44, further comprising the steps of:

modifying a sixth audio input signal using a front-to-back filter;

combining the modified sixth audio input signal with the signals being received by the left and right main speakers such that, in addition to the signals specified in claim 44, approximately equal quantities of the modified sixth audio input signal are transmitted to and reproduced by the left and right main speakers;

wherein the reproduced sound associated with the sixth audio input signal is perceived by a listener located in the listening area to originate from a location generally behind the listener.

46. The method of claim 34, further comprising the steps of:

combining the second audio input signal with the first audio input signal after modification of said first audio input signal by the first front-to-back filter;

combining the third audio input signal with the fourth audio input signal after modification of said fourth audio input signal by the second front-to-back filter;

subtracting the combination of the modified fourth audio input signal and the third audio input signal from the combination of the modified first audio input signal and the second audio input signal, transmitting the resulting difference signal to the left sub-speaker, and reproducing the difference signal in the left-sub-speaker; and subtracting the combination of the modified first audio input signal and the second audio input signal from the combination of the modified fourth audio input signal and the third audio input signal, transmitting the resulting difference signal to the right sub-speaker, and reproducing the difference signal in the right sub-speaker;

wherein the reproduced sound associated with the second and third audio input signals is perceived by a listener located in the listening area whose head is oriented generally toward the speaker locations to originate from a broad range of sound locations generally in front of the listener location and extending beyond said left and right sub-speakers; and wherein the reproduced sound associated with the first and fourth audio input signals is perceived by a listener located in the listening area whose head is oriented generally toward the speaker locations to originate from a broad range of sound locations extending beyond the locations of said left and right sub-speakers and including the area behind the listener.

47. The method of claim 46, further comprising the steps of:

limiting the frequency response of the portion of the combined modified first and second audio input signal transmitted to the left sub-speaker to below a certain frequency; and limiting the frequency response of the portion of the combined modified third and fourth audio input signal transmitted to the right sub-speaker to below a certain frequency;

wherein the apparent sound locations of the reproduced sound associated with the first, second, third and fourth audio input signals are perceived by a listener located in the listening area whose head is oriented generally toward the speaker locations to be more stable and more tolerant of movements of the listener's head.

48. The method of claim 47, wherein the frequency response of the portion of the combined modified first and second audio input signal transmitted to the left sub-speaker and the frequency response of the combined modified third and forth audio input signal transmitted to the right sub-speaker are limited to below approximately 5 KHz.

49. The method of claim 47, wherein the frequency response of the portion of the combined modified first and second audio input signal transmitted to the left sub-speaker and the frequency response of the combined modified third and forth audio input signal transmitted to the right sub-speaker are limited to below approximately 1.8 kHz.

50. The method system of claim 47, wherein the frequency response of the portion of the combined modified first and second audio input signal transmitted to the left sub-speaker and the frequency response of the combined modified third and forth audio input signal transmitted to the right sub-speaker are limited to below approximately 1 kHz.

51. The method of claim 47, further comprising the steps of:

limiting the frequency response of that portion of the combined modified first and second audio input signal subtracted from the combined modified third and fourth audio input signal to below a certain frequency; and limiting the frequency response of that portion of the combined modified third and fourth audio input signal subtracted from the combined modified first and second audio input signal to below a certain frequency;

wherein the apparent sound locations of the reproduced sound associated with the first, second, third and fourth audio input signals are perceived by a listener located in the listening area whose head is oriented generally toward the speaker locations to be more stable and more tolerant of movements of the listener's head.

52. The method of claim 46, further comprising the steps of:

limiting the frequency response of that portion of the combined modified first and second audio input signals which is subtracted from the combined modified third and fourth audio input signals to above a certain frequency prior to reproduction by the right sub-speaker; and limiting the frequency response of that portion of the combined modified third and fourth audio input signals which is subtracted from the combined modified first and second audio input signals to above a certain frequency prior to reproduction by the left sub-speaker;

wherein the resulting signal received by the left sub-speaker has low-frequency content primarily composed of information only from the combined modified first and second audio input signals; and wherein the resulting signal received by the right sub-speaker has low-frequency content primarily composed of information only from the combined and modified third and fourth audio input signals.

53. The method of claim 46, further comprising the step of combining a fifth audio input signal with the signals being received by the left and right main speakers such that, in addition to the signals specified in claim 46, approximately equal quantities of the fifth audio input signal are transmitted to and reproduced by the left and right main speakers;

wherein the reproduced sound associated with the fifth audio input signal is perceived by a listener located in the listening area whose head is oriented generally toward the speaker locations to originate approximately from a location equidistant between the left and right main speakers.

54. The method of claim 53, further comprising the steps of:

modifying a sixth audio input signal using a front-to-back filter; and combining the modified sixth audio input signal with the signals being received by the left and right main speakers such that, in addition to the signals specified in claim 53, approximately equal quantities of the sixth audio input signal are transmitted and reproduced by the left and right main speakers;

wherein the reproduced sound associated with the sixth audio input signal is perceived by a listener whose head is located generally at the listening location to originate from a location generally behind the listener.

55. A method for producing phantom surround sound effect from a loudspeaker system located in front of a listener, comprising the steps of:

providing a left main speaker and a right main speaker disposed respectively at left and right main speaker locations spaced along a speaker axis defined as a line passing through said left and right main speaker locations, with a listening area comprising the general area in front of the left and right main speaker locations such that the left main speaker location lies to the left and the right main speaker location lies to the right when viewed from the listening area;

providing a left front speaker and a right front speaker disposed generally in front of a listener in the listening area;

providing a left sub-speaker and a right sub-speaker disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations and are spaced a distance d from the respective left and right main speaker locations such that the distance d is in the range from approximately 50% to 150% of the average spacing between a person's ears as measured in a straight line through the head;

modifying a first audio input signal, transmitting the modified first audio input signal to the left main speaker, and reproducing sound associated with the modified first audio input signal in the left main speaker;

modifying a fourth audio input signal, transmitting the modified fourth audio input signal to the right main speaker, and reproducing the sound associated with the modified fourth audio input signal in the right main speaker;

transmitting a second audio input signal to the left front speaker and reproducing sound associated with the second audio input signal in the left front speaker;

transmitting a third audio input signal to the right front speaker and reproducing sound associated with the third audio input signal in the right front speaker;

subtracting the modified fourth audio input signal from the modified first audio input signal, transmitting the resulting difference signal to the left sub-speaker, and reproducing sound associated with the difference signal in the left sub-speaker; and subtracting the modified first audio input signal from the modified fourth audio input signal, transmitting the resulting difference signal to the right sub-speaker, and reproducing sound associated with the difference signal in the right sub-speaker;

wherein the reproduced sound associated with the second and third audio input signals is perceived by a listener located in the listening area whose head is oriented generally toward the speaker locations to originate from a range of sound locations approximately between the left front speaker and the right front speaker;

wherein the reproduced sound associated with the first and fourth audio input signals is perceived by a listener located in the listening area whose head is oriented generally toward the speaker locations to originate from a broad range of sound locations extending beyond the locations of said left and right sub-speakers.

56. The method of claim 55, further comprising the steps of:

combining a fifth audio signal input with the signals being received by the left front speaker and the right front speaker such that in addition to the signals specified in claim 55, approximately equal quantities of the fifth audio input signal are transmitted to and reproduced by the left and right front speakers;

wherein the reproduced sound with the fifth audio input signal is perceived by a listener located in the listening area whose head is oriented generally toward the speaker locations to originate approximately from a location equidistant between the left and right front speakers.

57. The method of claim 56, further comprising the steps of:

modifying a sixth audio input signal using a front-to-back filter; and combining the modified sixth audio input signal with the signals being received by the left front speaker and the right front speaker, such that in addition to the signals specified in claim 56, approximately equal quantities of the modified sixth audio input signal are transmitted and reproduced by the second left and right front speakers, wherein the reproduced sound associated with the sixth audio input signal is perceived by a listener whose head is located generally at the listening location to originate from a location generally behind the listener.

58. The method of claim 31 or 46, further comprising the step of:

converting a two-channel audio input signal to into a multi-channel audio output comprising at least four audio output signals, wherein the at least four audio output signals are the first audio input signal, the second audio input signal, the third audio input signal, and the fourth audio input signal of claim 31 or 46.

59. The method of claim 31 or 46, further comprising the steps of:

converting a two-channel audio input signal into a multi-channel audio output comprising five audio output signals;

transmitting four of the five audio output signals such that they are the first audio input signal, the second audio input, the third audio input signal, and the fourth audio input signal;

transmitting the fifth audio output signal such that it is a fifth audio input signal reproduced by a center front speaker;

wherein the reproduced sound associated with the fifth audio input signal is perceived by a listener located in the listening area whose head is oriented generally toward the speaker locations to originate from approximately the location of said center front speaker.

* * * * *